US010787761B2

(12) United States Patent
Czarnecki et al.

(10) Patent No.: US 10,787,761 B2
(45) Date of Patent: Sep. 29, 2020

(54) LAUNDRY TREATING SYSTEM AND KIT FOR USE WITH A LAUNDRY TREATING APPLIANCE

(71) Applicant: WHIRLPOOL CORPORATION, Benton Harbor, MI (US)

(72) Inventors: Philip J. Czarnecki, Saugatuck, MI (US); Pamela R. Klyn, Benton Harbor, MI (US); Eric W. Merrow, Benton Harbor, MI (US); Jon Strait, St. Joseph, MI (US); Mary E. Zeitler, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 234 days.

(21) Appl. No.: 15/683,170

(22) Filed: Aug. 22, 2017

(65) Prior Publication Data

US 2019/0062978 A1 Feb. 28, 2019

(51) Int. Cl.

| | |
|---|---|
| ***D06F 37/12*** | (2006.01) |
| ***D06F 17/10*** | (2006.01) |
| ***D06F 13/00*** | (2006.01) |
| ***D06F 37/24*** | (2006.01) |
| ***D06F 39/08*** | (2006.01) |
| ***D06F 39/02*** | (2006.01) |
| ***D06F 39/04*** | (2006.01) |
| ***D06F 37/30*** | (2020.01) |
| ***D06F 33/00*** | (2020.01) |
| ***D06F 34/28*** | (2020.01) |

(52) U.S. Cl.

CPC ..... *D06F 37/12* (2013.01); *D06F 13/00* (2013.01); *D06F 17/10* (2013.01); *D06F 33/00* (2013.01); *D06F 34/28* (2020.02); *D06F 37/24* (2013.01); *D06F 37/304* (2013.01); *D06F 39/02* (2013.01); *D06F 39/04* (2013.01); *D06F 39/085* (2013.01); *D06F 39/088* (2013.01); *D06F 2202/12* (2013.01)

(58) Field of Classification Search

CPC ..... D06F 13/02; D06F 23/04; D06F 13/00; D06F 39/024; D06F 29/00; D06F 17/10

USPC ..... 68/12.02, 134, 133, 4, 17 A, 27, 18 FA, 68/237; 366/238, 276

See application file for complete search history.

(56) References Cited

U.S. PATENT DOCUMENTS 1,795,395 A * 3/1931 Hoke ..... D06F 13/00 68/134

2,748,788 A 6/1956 Duckstein (Continued)

FOREIGN PATENT DOCUMENTS

BR DI7003246-7 10/2011

BR 102013015674 A2 7/2015

(Continued)

*Primary Examiner* — David G Cormier

*Assistant Examiner* — Thomas Bucci

(74) *Attorney, Agent, or Firm* — McGarry Bair PC

(57) ABSTRACT

A laundry treating system includes a laundry treating appliance having a first basket for receiving a first laundry load and a first clothes mover disposed in the first basket. The laundry treating system is user configurable between first, second, and third configurations. A kit for customizing a laundry treating appliance can include a second clothes mover and a second basket configured to removably couple with the laundry treating appliance.

23 Claims, 18 Drawing Sheets

(56) References Cited

U.S. PATENT DOCUMENTS 3,014,358 A 12/1961 Bochan
3,026,699 A * 3/1962 Rhodes ..... D06F 29/00 68/12.19
3,029,623 A 4/1962 Morey
3,145,551 A 8/1964 Ziegler
3,209,560 A * 10/1965 Shelton ..... D06F 13/00 68/4
3,324,688 A 6/1967 Hubbard
3,481,162 A * 12/1969 Ziegler ..... D06F 13/00 68/4
3,509,741 A 5/1970 Morey
3,575,020 A * 4/1971 Hubbard ..... D06F 33/00 68/4
3,648,486 A * 3/1972 Rosinski, Jr. ..... D06F 13/00 68/4
3,987,652 A * 10/1976 Ruble ..... D06F 13/00 68/134
4,118,957 A 10/1978 Marcussen
4,162,621 A * 7/1979 Stone ..... D06F 37/00 68/208
4,175,409 A 11/1979 Morey
4,186,573 A 2/1980 Brenner et al.
4,207,760 A * 6/1980 Bochan ..... D06F 13/02 68/134
4,225,992 A 10/1980 Morey
4,338,802 A * 7/1982 Ohmann ..... D06F 39/10 415/121.2
4,637,230 A 1/1987 Roberts
4,637,231 A * 1/1987 McMillan ..... D06F 33/00 68/4
4,920,770 A * 5/1990 Dooley ..... D06F 13/02 68/133
5,113,542 A 5/1992 Pastryk et al.
5,440,903 A * 8/1995 Kropf ..... D06F 13/02 68/134
5,497,638 A 3/1996 Berkcan et al.
5,611,221 A * 3/1997 Tremel ..... D06F 13/02 192/46
5,689,847 A * 11/1997 Tremel ..... D06F 13/02 68/134
5,784,902 A * 7/1998 Pinkowski ..... D06F 13/02 68/12.02
6,460,382 B1 10/2002 Kim et al.
7,401,479 B2 7/2008 Fields
7,866,191 B2 1/2011 Turner et al.
9,404,213 B2 * 8/2016 Kappler ..... D06F 95/002
2004/0016267 A1 * 1/2004 Clark ..... D06F 39/024 68/133
2005/0284197 A1 * 12/2005 Pinkowski ..... D06F 13/02 68/133
2007/0084254 A1 4/2007 Messina
2009/0211108 A1 8/2009 Moschutz et al.
2009/0293203 A1 * 12/2009 Hettinger ..... D06F 17/10 8/159
2011/0094902 A1 4/2011 Delehey et al.
2013/0276483 A1 10/2013 Ryu et al.
2013/0312462 A1 11/2013 Kim et al.
2015/0059417 A1 3/2015 Ramasco
2015/0184326 A1 * 7/2015 Seo ..... D06F 37/20 68/132
2015/0211163 A1 * 7/2015 Kim ..... D06F 17/10 68/133
2016/0201243 A1 * 7/2016 Bergamo ..... D06F 37/12 8/137
2016/0222567 A1 8/2016 Ramasco et al.
2016/0289884 A1 10/2016 Kim et al.
2019/0186064 A1 6/2019 Kim et al.

FOREIGN PATENT DOCUMENTS

BR 102013018364 A2 8/2015
BR 102013021866 A2 8/2015
BR 102013015672 A2 9/2015
BR 102013027400 A2 9/2015
BR 102013025343 A2 11/2015
BR 102014008903 A2 12/2015
BR 102014010905 A2 12/2015
BR 102014010908 A2 12/2015
BR 102014018397 A2 2/2016
CN 203530690 U 4/2014
CN 203729101 U 7/2014
CN 105220395 A 1/2016
KR 20030045447 A 6/2003
WO 2013088426 A2 6/2013
WO 2014201534 A1 12/2014
WO 2015048870 A1 4/2015
WO 2015058269 A1 4/2015

* cited by examiner

LAUNDRY TREATING SYSTEM AND KIT FOR USE WITH A LAUNDRY TREATING APPLIANCE

BACKGROUND

Laundry treating appliances, such as clothes washers, refreshers, and non-aqueous systems, can have a configuration based on a rotating laundry basket that defines a treating chamber in which laundry items are placed for treating. The laundry treating appliance can have a controller that implements a number of pre-programmed cycles of operation having one or more operating parameters. The controller can control a motor to rotate the laundry basket according to one of the pre-programmed cycles of operation. The controller can also control a clothes mover within the laundry basket to impart mechanical energy to laundry items according to a selected cycle of operation.

BRIEF SUMMARY

In one aspect of the present disclosure, a laundry treating system includes a laundry treating appliance having a first basket for receiving a first laundry load for treatment and a first clothes mover disposed in the first basket. A second clothes mover can be removably coupled to the laundry treating appliance, and a second basket can also be removably coupled to the laundry treating appliance.

Thus, the laundry treating system is user-configurable between first, second, and third configurations. In the first configuration, the second clothes mover is coupled to the laundry treating appliance and the second basket is also coupled to the laundry treating appliance for receiving a second laundry load for treatment. In the second configuration, the second basket is decoupled from the laundry treating appliance, but the second clothes mover remains coupled to the laundry treating appliance. In the third configuration, both the second clothes mover and the second basket are decoupled from the laundry treating appliance.

In another aspect of the present disclosure, a kit for customizing a laundry treating appliance is provided. The laundry treating appliance includes a first basket for receiving a first laundry load for treatment and a first clothes mover disposed within the first basket. The kit includes a second clothes mover removably coupled with the laundry treating appliance and a second basket capable of being coupled to the laundry treating appliance to receive a second laundry load for treatment.

In still another aspect, a laundry treating system includes a laundry treating appliance that is customizable by a user to operate in one of three configurations. The laundry treating appliance includes a first basket for receiving a first load for treatment in all three configurations. In a first configuration, both a second basket and a second clothes mover are removably coupled to the laundry treating appliance. In a second configuration, the second laundry basket is decoupled, but the second clothes mover is removably coupled to the laundry treating appliance. In a third configuration, both the second clothes mover and the second basket are decoupled, leaving the first clothes mover disposed in the first basket. The first, second, and third configurations are user selectable prior to executing a cycle of operation of the laundry treating appliance.

DESCRIPTION

Aspects of the disclosure relate to a laundry treating system that includes a laundry treating appliance which can be configurable by a user into one of three different configurations to provide different treatment environments based on the user's laundry treatment needs or preferences. In one configuration, the laundry treating appliance can be configured as a dual-basket system that includes a first, main laundry basket and a second, removable laundry basket that is received at least partially within the first laundry basket. The dual-basket configuration provides a user with two separate treatment chambers—a first treatment chamber in the first laundry basket and a second treatment chamber in the second laundry basket. This enables the user to wash multiple loads in parallel.

The laundry treatment appliance can also be configured as a single-basket system. When being used as a single-basket system, the laundry treatment appliance can be utilized with one of two different configurations, each utilizing a different type of clothes mover, based on the user's treatment needs. In one such configuration, the user elects to use a clothes mover that includes a vertically oriented agitator post. Such a configuration may be useful if the user wishes to impart high quantities of mechanical action onto particularly soiled clothing, or if the user wishes to perform deep water washing. In another configuration, however, the user elects to use a clothes mover with a lower profile impeller that does not include an agitator post. Such a configuration may be useful for low water washing, or for washing bulky items (e.g., comforters) that would tangle around an agitator post.

The user can customize the clothes mover based on the user's personal preferences or based on characteristics of the laundry to be treated, examples of which include an amount of laundry to be treated, a size of the item(s) to be treated, soil level of the laundry, an amount and/or type of mechanical energy to be applied to the laundry, the type of fabric of the laundry (e.g. whether the laundry is delicate or rugged), and a fill level of liquid during treatment.

Figure 1:
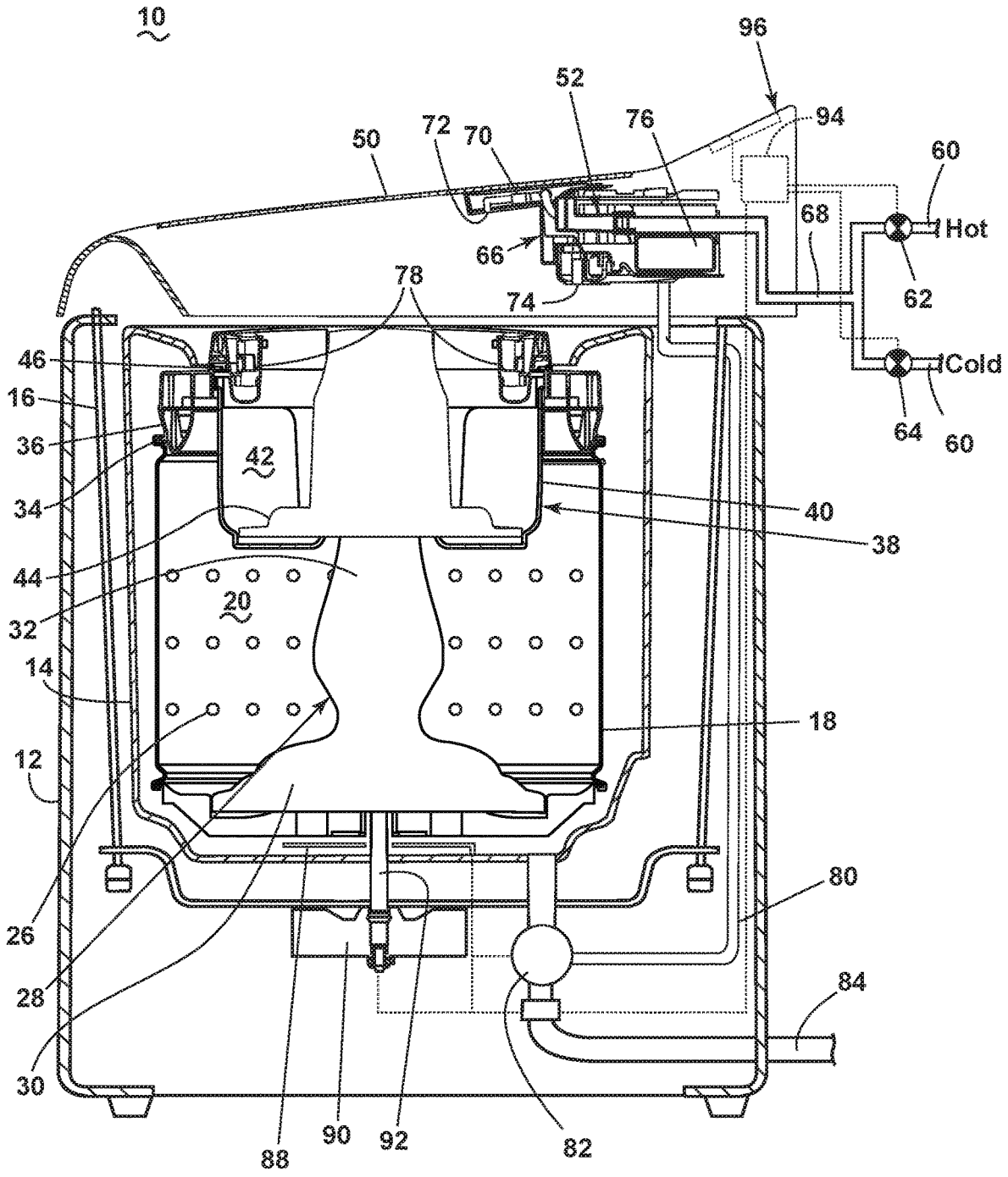
FIG. 1 is a schematic view of a laundry treating appliance in the form of a washing machine having a first basket and a removable basket assembly in a first configuration according to the present disclosure.

By way of overview, FIG. 1 is illustrative of an example of a first configuration in which the user has configured the laundry treating system as a dual-basket system. The user can select this configuration to separately treat two different laundry loads based on the characteristics of the loads such as the amount of laundry, amount/type of mechanical energy to be applied, laundry color, soil level of the laundry, and/or type of fabric. For example, the user can place delicate items in a second, removable laundry basket 40 and less delicate items can be treated in a first, main laundry basket 18.

Figure 2:
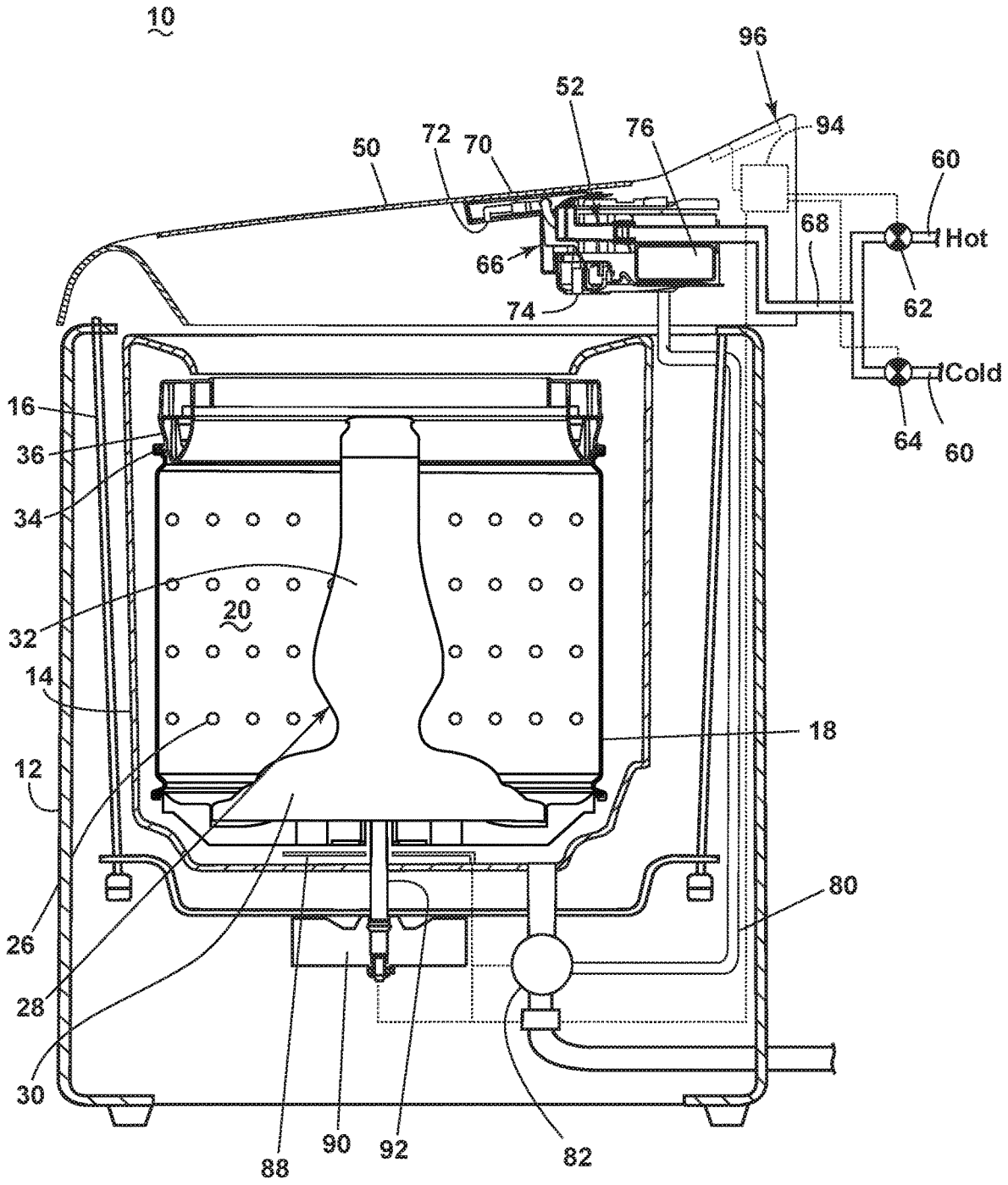
FIG. 2 is a schematic view of a laundry treating appliance in the form of a washing machine having a clothes mover in a second configuration according to the present disclosure.
Figure 3:
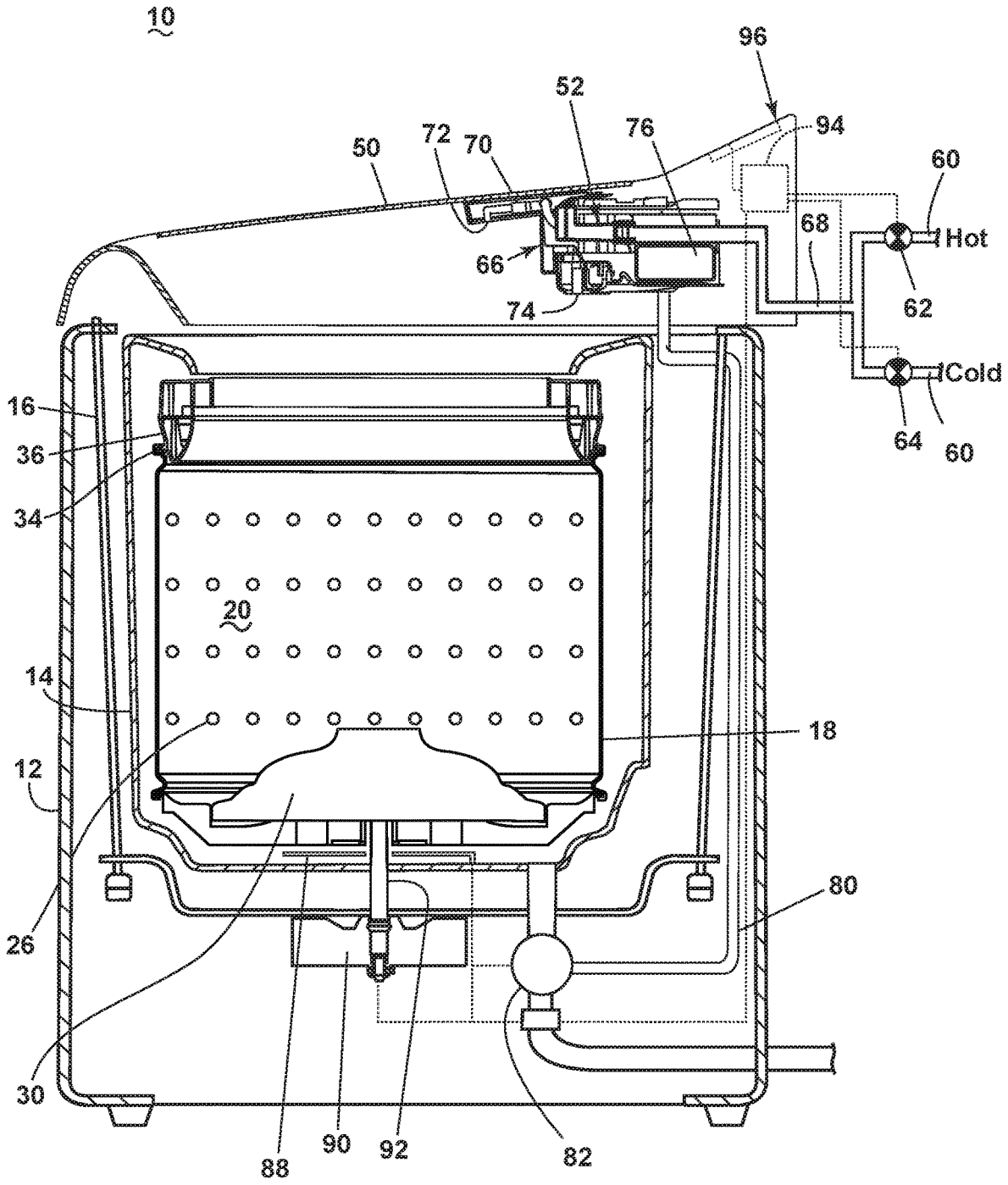
FIG. 3 is a schematic view of a laundry treating appliance in the form of a washing machine having a clothes mover in a third configuration according to the present disclosure.

FIGS. 2 and 3 are illustrative of examples of second and third configurations the user can select for treating a laundry load, utilizing two different clothes movers 28 and 30. In the second and third configurations, the second basket 40 is removed and only the first, main laundry basket 18 is utilized for treatment of the laundry load. The user can select between the two different clothes movers based on characteristics of the laundry and/or based on the user's preferences.

For example, the user can utilize the second clothes mover 28 illustrated in the configuration of FIG. 2 for use in implementing a treatment mode having a significant mechanical action, deep water washing, or based on the user's preference for the second clothes mover 28. The user can selectively configure the laundry treating system to utilize the first clothes mover 30 illustrated in the configuration of FIG. 3 for use in treating large and/or bulky loads or to implement a low water treatment mode, for example, or based on the user's preference.

Figure 4:
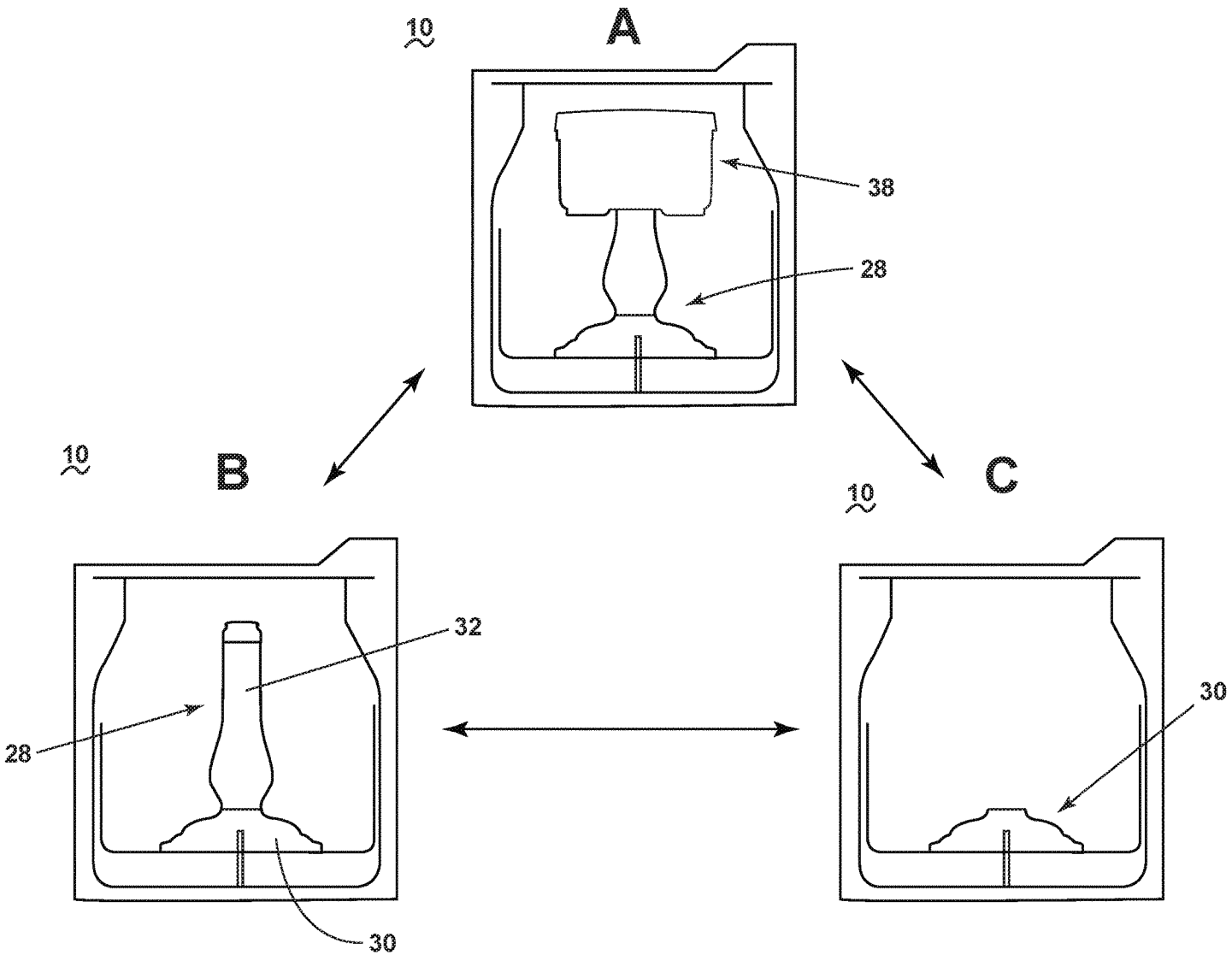
FIG. 4 is a schematic view of a laundry treating system according to the present disclosure.

Referring now to FIG. 4, aspects of the laundry treating system described herein allow the user to selectively assemble and disassemble the second laundry basket 40, the second clothes mover 28, and the first clothes mover 30 to configure the laundry treating system into one of the three configurations. The laundry treating system can be configured in the first configuration "A" by assembling the second clothes mover 28 and the second laundry basket 40 in the laundry treating appliance. The laundry treating system can be configured in the second configuration "B" by assembling the second clothes mover 28 within the laundry treating appliance and decoupling (i.e., removing) the second laundry basket 40. The laundry treating system can also be configured in the third configuration "C" by assembling only the first clothes mover 30 in the laundry treating appliance and decoupling both the second clothes mover 28 and the second laundry basket 40. The components of the laundry treating system are configured to allow a user to configure and re-configure the laundry treating system in any one of the configurations A, B, and C as desired.

In more detail, and referring again to FIG. 1, a laundry treating system according to an aspect of the disclosure includes a laundry treating appliance 10 that can be any appliance that performs a cycle of operation to clean or otherwise treat items placed therein. The laundry treating appliance 10 is illustrated as a washing machine, which can include a structural support system comprising a cabinet 12 defining a housing within which a laundry holding system resides. The cabinet 12 can be a housing having a chassis and/or a frame, defining an interior, enclosing components typically found in a conventional washing machine. Conventional washing machine components are not described in detail, but are described briefly as needed to provide an illustrative environment to support a complete understanding of aspects of the present disclosure.

The laundry treating appliance 10 includes a tub 14 supported within the cabinet 12 by a suitable suspension system 16 for dynamically suspending portions of the laundry treating appliance 10 within the cabinet 12. A first or main laundry basket 18 is provided within the tub 14 and defines a first treating chamber 20. The first laundry basket 18 can include a plurality of perforations 26 such that liquid can flow between the tub 14 and the first laundry basket 18 through the perforations 26 during treatment of the laundry. A balance ring 36 can be provided adjacent the open end 34 of the first laundry basket 18.

Figure 12:
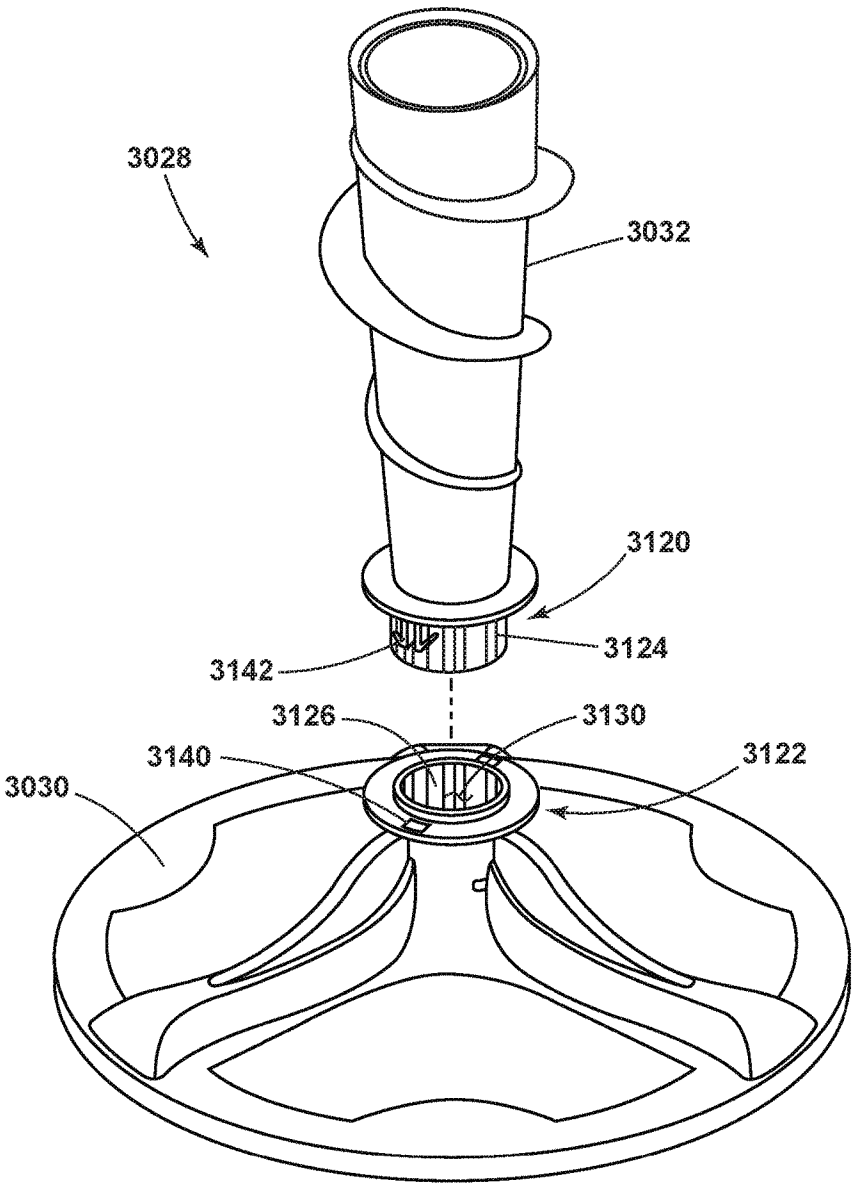
FIG. 12 is a perspective view of a clothes mover according to the present disclosure.

A second clothes mover 28 is provided within the first treating chamber 20 to impart mechanical energy to laundry items received in the first treating chamber 20 according to a cycle of operation. The second clothes mover 28 includes a vertically oriented agitator post 32 removably coupled with the first clothes mover 30 and projecting vertically from the first clothes mover 30 within the first treating chamber 28 toward an open end 34 of the first laundry basket 18. In this aspect of the disclosure, the second clothes mover 28 is thus formed by coupling an additional component, the agitator post 32, to the first clothes mover 30. The agitator post 32 can include any configuration of vanes, blades, or other structural features for imparting mechanical energy to laundry items during a cycle of operation. In one example, the agitator post 32 may be in the form of an auger (FIG. 12). Generally, the vertical extent of the agitator post 32 combined with vane, blade, or other structural features can impart mechanical action to clothing, which provides improved cleaning performance and may be suitable for particularly soiled loads.

A removable basket assembly 38 can include a second, removable basket 40 that is at least partially disposed within the first laundry basket 18 and defines a second treating chamber 42. An auxiliary clothes mover 44 can be provided within the second laundry basket 40 for imparting mechanical energy to the laundry items in the second laundry basket 40 during a cycle of operation.

The removable basket assembly 38 can be supported within the first laundry basket 18 by the second clothes mover 28 and/or the first laundry basket 18. In one example, the removable basket assembly 38 includes an upper ring 46 that can be seated on the balance ring 36 for supporting the removable basket assembly 38 within the first laundry basket 18. Optionally, the removable basket assembly 38 is supported on the second clothes mover 28 in addition to, or as an alternative to, seating the removable basket assembly 38 on the balance ring 36 of the first laundry basket 18. Non-limiting examples of configurations for supporting the removable basket assembly 38 within the first laundry basket 18 are disclosed in Applicant's co-pending application, application Ser. No. 15/651,589, entitled "Laundry Treating Appliance with Removable Basket," filed Jul. 17, 2017, U.S. Pub. No. 2015/0059417 to Ramasco, filed Aug. 27, 2014, now abandoned, entitled "Valved Dispensing System for Products in Liquid Form by Inertial Centrifugal Action for Household Appliances," and U.S. Pub. No. 2016/0222567 to Ramasco et al., filed Oct. 23, 2015, now U.S. Pat. No. 9,863,078, issued Jan. 9, 2018, entitled "Coupling System of Removable Compartment for Appliances," all of which are herein incorporated by reference in their entirety.

The laundry treating appliance 10 can further include a door 50, which is movably mounted to the cabinet 12 to selectively close the tub 14, the first laundry basket 18, and the second laundry basket 40. A liquid supply system 52 is provided for supplying water to the laundry treating appliance 10 for use in treating laundry during a cycle of operation. The liquid supply system 52 can include a source of water, such as a household water supply 60, which can include separate valves 62 and 64 for controlling the flow of hot and cold water, respectively. Water can be supplied to a liquid manifold 66 via a supply conduit 68. Optionally, one or more additional valves can be included on the supply conduit 68 to selectively provide water to the liquid manifold 66, or to tailor water temperature from the household water supply 60.

In one example, a water dispenser 70, fluidly coupled to the liquid manifold 66, can mount to the door 50, for providing water to one or more of the first and second laundry baskets 18 and 40 via a first outlet 72. The water dispenser 70 can overhang above the first and second laundry baskets 18 and 40 such that water dispensed from the first outlet 72 can pass into the second laundry basket 40 when using the removable basket assembly 38, or into the first laundry basket 18 when the removable basket assembly 38 is not being used. Optionally, a second outlet 74 can be provided on the liquid manifold 66 dedicated to the first laundry basket 18. The second outlet 74 can be positioned outside of the second laundry basket 40, such that any dispensed water will pass into the space between the first laundry basket 18 and the upper ring 46, passing into the first treating chamber 20, but not into the second treating chamber 42. Additional and/or alternative configurations can be utilized to selectively provide water to the first laundry basket 18 and the second laundry basket 40 individually or in combination. In one example, the laundry treating appliance 10 can include a single water dispenser such that when the second laundry basket 40 is present, water is supplied to the first laundry basket 18 through the second laundry basket 40 (e.g. such as by overflowing from the second laundry basket 40 to the first laundry basket 18) and when the second laundry basket 40 is not present, water is supplied directly to the first laundry basket 18. In another example, the laundry treating appliance 10 includes multiple water dispensers configured to separately supply water to the first and second laundry baskets 18 and 40.

A dispenser 76 can be provided within or adjacent to the liquid manifold 66 and in fluid communication with the liquid manifold 66. The dispenser 76 can be used to dispense treating chemistry to the first laundry basket 18 through the second outlet 74. The removable basket assembly 38 is optionally provided with one or more dispensers 78 for dispensing a treating chemistry into the second laundry basket 40. Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry treating appliance 10 can also include a recirculation and drain system for recirculating or draining liquid within the laundry treating appliance 10 including a recirculation conduit 80, a pump 82, and a drain conduit 84. The liquid supply and/or recirculation and drain system can be provided with a heating system which can include one or more devices for heating laundry and/or liquid supplied to the tub 14, such as a sump heater 88, which can be used to heat the laundry and/or liquid within the tub 14 as part of a cycle of operation.

The laundry treating appliance 10 also includes a drive system for rotating the first and second laundry baskets 18 and 40 within the tub 14. The drive system can include a motor 90, which can be directly coupled with the first laundry basket 18 and the second clothes mover 28 through a drive shaft 92 to rotate or reciprocate the first laundry basket 18 and/or the second or first clothes movers 28, 30 about a rotational axis during a cycle of operation. Optionally, the rotational movement of the second clothes mover 28 can be imparted to the auxiliary clothes mover 44 and/or rotational movement of the first laundry basket 18 can be imparted to the second laundry basket 40. The type of motor and the manner in which the motor drives the first laundry basket 18, second and first clothes movers 28, 30, the second laundry basket 40, and/or the auxiliary clothes mover 44 may vary from what is illustrated according to other types of motors and connections recognized in the art.

The laundry treating appliance 10 also includes a control system for controlling the operation of the laundry treating appliance 10 to implement one or more cycles of operation. The control system can include a controller 94 and a user interface 96 that is operably coupled with the controller 94. The user interface 96 is configured to receive input from a user and provide output to the user. Such input can be used to select a cycle of operation or a cycle option/parameter, for example. Non-limiting examples of output from the user interface 96 include information related to the cycle of operation, such as status, selected or recommended options/parameters, and laundry treating appliance configuration. The input can be communicated to the controller 94, indicative of and including instructions to execute the cycle of operation, set options, and/or select a configuration. The user interface 96 can include one or more knobs, dials, switches, displays, touch screens and the like for communicating with the user, such as to receive input and provide output.

Figure 5:
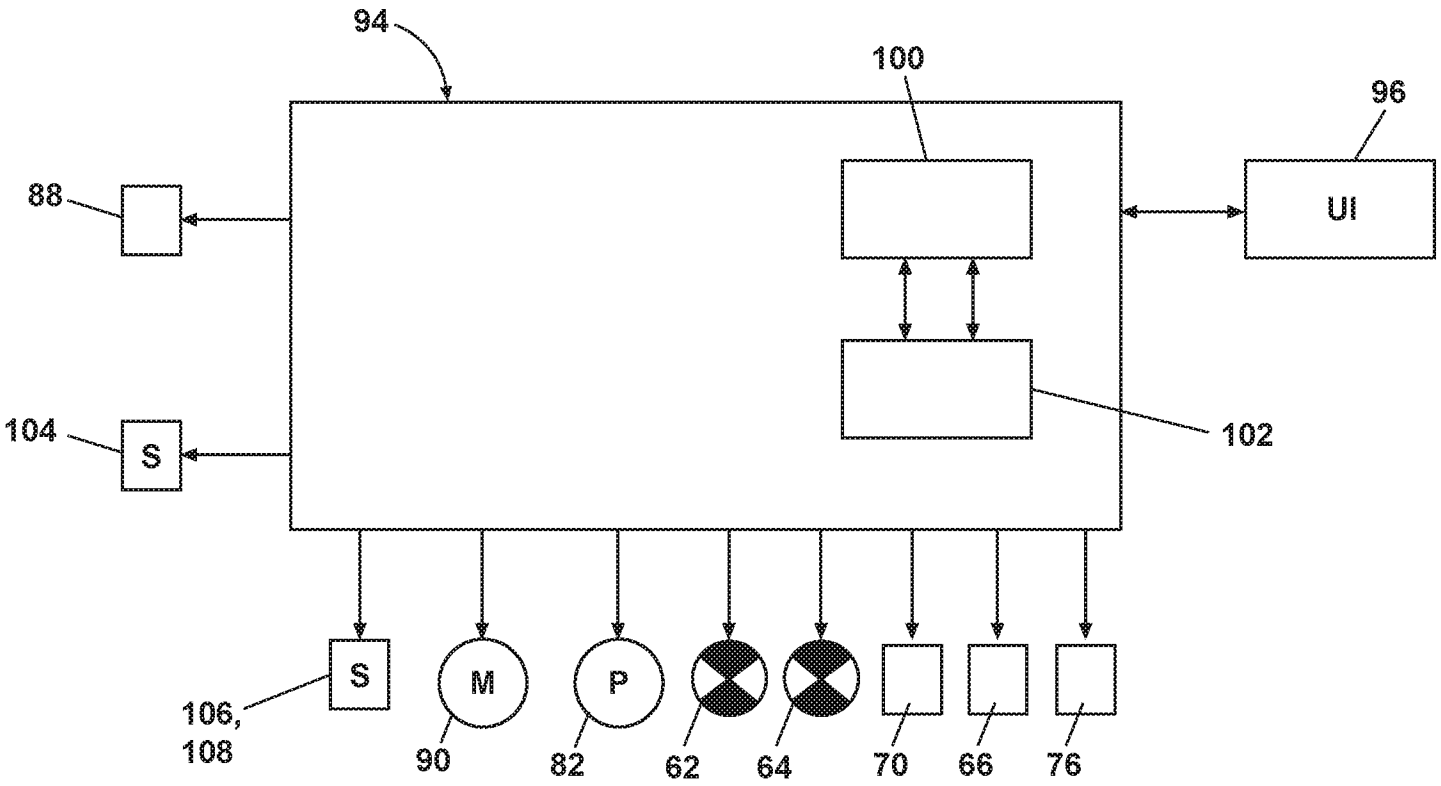
FIG. 5 is a schematic view of a control system of the laundry treating appliance of FIG. 1.

Referring to FIG. 5, the controller 94 can be provided with a memory 100 and a central processing unit (CPU) 102. The memory 100 can be used for storing the control software that is executed by the CPU 102 in completing a cycle of operation using the laundry treating appliance 10 and any additional software. Examples, without limitation, of cycles of operation include: wash, heavy duty wash, delicate wash, quick wash, pre-wash, refresh, rinse only, and timed wash. The controller 94 can include the machine controller and any additional controllers provided for controlling any of the components of the laundry treating appliance 10. For example, the controller 94 can include the machine controller and a motor controller. It is contemplated that the controller 94 is a microprocessor-based controller that implements control software and sends/receives one or more electrical signals to/from each of the various working components to effect the control software.

The controller 94 can be operably coupled with one or more components of the laundry treating appliance 10 for communicating with and controlling the operation of the component to complete a cycle of operation. For example, the controller 94 can be operably coupled with the pump 82, the sump heater 88, and the motor 90 to control the operation of these and other components to implement one or more of the cycles of operation. The controller 94 can also be coupled with one or more sensors 104 provided in one or more of the systems of the laundry treating appliance 10 to receive input from the sensors, which are known in the art and not shown for simplicity.

According to one aspect of the disclosure, a sensor 106 can be provided to determine the presence/absence of the removable basket assembly 38 within the laundry treating appliance 10. In one example, detection of the removable basket assembly 38 can be detected in a manner similar to that disclosed in U.S. Pat. Pub. No. 2016/0201243 to Bergamo, filed Oct. 23, 2015, now U.S. Pat. No. 9,777,417, issued Oct. 3, 2017, entitled "Detection System of Washing Machines Removable Basket and Method for Detection of Washing Machines Removable Basket," which is herein incorporated by reference in full. In another aspect of the present disclosure, a sensor 108 is provided to determine the presence/absence of the second or first clothes movers 28 and 30 of FIGS. 2 and 3.

The sensors 106, 108 may be any suitable type of sensor configured to determine the presence or absence of the associated component and provide an output to the controller 94 indicative of the presence or absence of the component. The sensors 106 and 108 may be the same type of sensor or different. Non-limiting examples of suitable types of sensors 106, 108 include optical sensors, electrical sensors, and electromechanical sensors. In one example, the sensor 106, 108 can be of the type in which a circuit is completed when the associated component—the basket assembly 38 or second clothes mover 28—is present and the completion of the circuit is provided as an output to the controller 94 to indicate the presence of the associated component. In another example, the sensor 106, 108 can include an optical sensor in which a light source provides illumination that is detected by a suitable detector when the associated component, the basket assembly 38 or second clothes mover 28, is not present and when the associated component is present, the illumination is blocked. The detector can be configured to output a signal indicative of the presence or absence of the component to the controller 94 based on whether or not the illumination reaches the detector.

Referring again to FIG. 1, in operation in the first configuration, the user can place laundry items within first laundry basket 18 for treatment and additional laundry items can be placed within the second laundry basket 40 for treatment. Optionally, the user can utilize the first configuration illustrated in FIG. 1 to treat items within the second laundry basket 40 without adding items to the first laundry basket 18.

When both the removable basket assembly 38 and the first laundry basket 18 are in use for treating laundry items, treating chemistry can be provided in one or more of the dispensers 76, 78, as desired, to treat the laundry articles according to a desired cycle of operation. The controller 94 and user interface 96 can be configured to allow a user to select a cycle of operation through the user interface 96 for implementation by the controller 94. In one aspect of the disclosure, the controller 94 and user interface 96 are configured to allow a user to select a single cycle of operation which is implemented by the controller 94 for both the first treating chamber 20 in the first laundry basket 18 and the second treating chamber 42 in the second laundry basket 40.

In another aspect of the disclosure, the controller 94 and the user interface 96 are configured to allow a user to select one or more cycles of operation for implementing different cycles of operation in each of the first and second treating chambers 20, 42. For example, the user interface 96 may be configured to allow a user to select individual cycles of operation for each of the first and second treating chambers 20, 42. In another example, the user interface 96 may be configured to allow a user to select from one or more pre-determined combinations of cycles of operation for implementing in each of the first and second treating chambers 20, 42. An exemplary controller and user interface configuration is disclosed in Applicant's co-pending application, application Ser. No. 15/651,570, entitled "Selectable Method of Control for Double Basket Laundry Treating Appliance," filed Jul. 17, 2017, the contents of which are incorporated herein by reference in their entirety.

In an exemplary cycle of operation, during a treatment phase of a selected cycle of operation, such as a wash phase, water dispensed from the second outlet 74 is supplied to the first laundry basket 18 and passes through the perforations 26 into the tub 14. Water can also be supplied to the second laundry basket 40 through the first outlet 72 of the water dispenser 70. Water can be supplied to the first and second laundry baskets 18, 40 simultaneously or consecutively. A treating chemistry can be dispensed into the first treating chamber 20 from the dispenser 76 in the liquid manifold 66 and can be dispensed into the second treating chamber 42 from the dispenser 78 on the upper ring 46. The second clothes mover 28 and optionally the auxiliary clothes mover 44, can agitate the articles within the first and second treating chambers 20, 42, respectively, according to the selected cycle(s) of operation.

During a drain phase of the selected cycle of operation, liquid collected in a sump area of the tub 14 can be drained by the pump 82 through the drain conduit 84. The motor 90 can be operated to rotate the first laundry basket 18 and impart rotational movement to the second laundry basket 40 to drive liquid within the second laundry basket 40 outward and upward toward outlets disposed in an upper portion of the second laundry basket 40, where the liquid can then drain over the balance ring 36 and into the tub 14. The liquid can then be disposed of through the drain conduit 84.

A rinse phase can be implemented by supplying liquid to both the first and second treating chambers 20, 42 in a manner similar to that described above for the treatment phase. A spin or extraction phase can be implemented by rotating the first laundry basket 18 and/or the second laundry basket 40 according to the selected cycle of operation.

The laundry treating system can also be configured such that a cycle of operation can be implemented using the second laundry basket 40 without treating items in the first laundry basket 18. Implementation of a cycle of operation in the second laundry basket 40 alone can be implemented in a manner similar to that described above except that the liquid supply system 52 and dispensing system are operated to supply water and treating chemistry to only the second laundry basket 40 and not the first laundry basket 18.

Referring again to FIG. 2, the laundry treating appliance 10 can be operated to implement a cycle of operation to treat laundry in the first laundry basket 18 alone, without the removable basket assembly 38. To re-configure the laundry treating appliance 10 from the first configuration of FIG. 1 to the second configuration of FIG. 2, the user removes the removable laundry basket assembly 38 and sets it aside.

Optionally, the laundry treating appliance 10 can be configured to facilitate storage of the removable laundry basket assembly 38 when not in use. For example, the laundry treating appliance 10 can include a storage element that suspends the removable laundry basket 38 from the laundry treating appliance 10, such as a hook, clamp, hanger, or suspending rod. In another example, the storage element can be in the form of a shelf, drawer, or cavity configured to support the removable laundry basket assembly 38. In another aspect of the disclosure, a companion laundry dryer or laundry module can include the storage element configured to store the removable laundry basket assembly 38.

The second configuration, in which the first laundry basket 18 is used with the second clothes mover 28, but without the removable laundry basket 38, may be suitable for users who prefer agitator-based washing. For example, the user may prefer a deeper water wash than is traditional used with an impeller-type clothes mover, such as the first clothes mover 30. In another example, the user may choose the second configuration based on a preference for the type of mechanical action imparted by the agitator-type second clothes mover 28. The preference for the second configuration may be based on a personal preference or based on characteristics of the laundry, such as for example a soil level of the clothing. For heavily soiled laundry, the user may prefer the mechanical action imparted by the agitator-type second clothes mover 28 and thus select the second configuration.

The user can select a cycle of operation through the user interface 96 for implementation by the controller 94 in treating the laundry items in the first laundry basket 18. The controller 94 may be configured to implement a cycle of operation with the first laundry basket 18 in the same or a different manner based on the presence or absence of the removable laundry basket assembly 38. For example, the first laundry basket 18 and/or the second clothes mover 28 may be rotated in a different manner when the removable laundry basket assembly 38 is present compared to when the removable laundry basket assembly 38 is absent, even if the user selects the same cycle of operation to be implemented using the first laundry basket 18. Optionally, the user may utilize the laundry treating appliance to implement a cycle of operation with the first laundry basket 18 while leaving the removable laundry basket assembly 38 assembled within the laundry treating appliance 10.

The presence and/or absence of the removable laundry basket assembly 38 may be determined automatically using the sensor 106 and/or based on user input through the user interface 96. For example, the user interface 96 may include a dedicated input which a user can select to indicate whether or not the removable laundry basket assembly 38 is present and/or is to be used to treat laundry. Optionally, the controller 94 and the user interface 96 are configured to activate predetermined cycles of operation and/or cycle options based on the presence or absence of the removable laundry basket assembly 38. In another example, the controller 94 may be configured to determine the presence or absence of the removable laundry basket assembly 38 based on the cycle of operation selected by the user.

Referring again to FIG. 3, to operate the laundry treating appliance 10 in the third configuration, the removable laundry basket assembly 38 and the second clothes mover 28 are disassembled and removed from the laundry treating appliance 10 and the first clothes mover 30 is assembled within the first laundry basket 18. To assemble the first clothes mover 30, the agitator post 32 of the second clothes mover 28 is configured to separate from the first clothes mover 30 while the first clothes mover 30 remains coupled with the motor 90. The first clothes mover 30 is configured to operate as a clothes mover that is different than the second clothes mover 28 and independent of the agitator post 32, during a cycle of operation. In this manner, the laundry treating system can be selectively re-configured by the user between the second and third configurations of FIGS. 2 and 3 to utilize two different clothes movers.

The third configuration, in which the first laundry basket 18 is used with the first clothes mover 30, but without the removable laundry basket 38, may be suitable for users who prefer impeller-based washing. The impeller-type clothes mover is suitable for users who prefer low water washing or gentler washing (i.e., lower mechanical action imparted to the laundry), for example. A user might choose the third configuration when washing large or bulky loads, such as blankets and comforters. Larger, bulky items generally do not fit well in the laundry basket when a vertical-oriented agitator-type clothes mover is present. The preference for the third configuration may be based on a personal preference or based on characteristics of the laundry, such as for example a size of the laundry item(s).

The controller 94 can be configured to implement the same cycles of operation independent of the presence of the second or first clothes movers 28, 30. In another aspect of the disclosure, the controller 94 is configured to implement at least one different cycle of operation based on the presence of either the second or first clothes movers 28, 30. In one example, the user interface 96 is configured to display a first set of predetermined selectable cycles of operation when the second clothes mover 28 is present and a second set of predetermined selectable cycles of operation when the first clothes mover 30 is present. The first and second sets of predetermined selectable cycles of operation may differ by one or more cycles of operations or based on one or more selectable options for a given set of selectable cycles of operation.

The presence or absence of either of the second or first clothes movers 28, 30 may be based on input from the sensor 108, input from the motor 90, and/or based on input by the user through the user interface 96. The second clothes mover 28 may include a sensor 108, non-limiting examples of which include an electro-mechanical sensor or a light sensor, which is configured to determine the presence or the absence of the agitator post 32. When the agitator post 32 is present, i.e. is coupled to the first clothes movers 30, the sensor 108 can provide an output to the controller 94 indicating that the second clothes mover 28 is present. When the agitator post 32 is absent, i.e. is un-coupled from the first clothes movers 30, the sensor 108 can provide an output to the controller 94 that the second clothes mover 28 is absent, indicating that only the first clothes mover 30 is present.

According to another aspect of the disclosure, the determination of the second or first clothes movers 28, 30 can be determined based on output from the motor 90. For example, the power utilized by the motor 90 in rotating the second clothes mover 28 at a first speed or acceleration may be different than the power utilized by the motor 90 in rotating the second first clothes mover 30 at the same speed or acceleration. The difference in power can be utilized by the controller 94 to determine whether the second or first clothes mover 28, 30 is present. Optionally, the controller 94 can be configured to alter one or more aspects of the selected cycle of operation based on the determination of the first or second clothes mover 28, 30.

In yet another aspect of the present disclosure, the user interface 96 can be provided with a dedicated input that can be selected by the user to indicate which of the second or first clothes movers 28, 30 is present within the first laundry basket 18. Optionally, the user interface 96 may be configured to allow a user to select from a predetermined set of cycles of operation based on the input regarding the second or first clothes mover 28, 30.

Referring again to FIG. 4, the laundry treating system described herein allows a user to customize the laundry treating appliance 10 for treating the laundry load or loads to be treated. The user can re-configure the laundry treating appliance between the removable basket assembly 38 configuration A, the second clothes mover 28 configuration B, and the first clothes mover configuration C. The user can select any of the configurations A, B, or C based on personal preference, the desired cycle of operation to be implemented, and/or characteristics of the laundry.

To utilize configuration C in which only the first clothes mover 30 is present in the laundry treating appliance 10, the user removes the second clothes mover 28 by uncoupling the agitator post 32 from the first clothes mover 30 and removes the basket assembly 38. The user can then utilize the laundry treating appliance 10 to implement a cycle of operation on a load of laundry in a conventional manner. To utilize configuration B, the user can couple the agitator post 32 to the first clothes mover 30 to form the second clothes mover 28.

To utilize configuration A, the user can assemble the basket assembly 38 in the laundry treating appliance 10. When the basket assembly 38 is configured to be supported at least in part by the second clothes mover 28, configuration A will include the second clothes mover 28. Optionally, if the basket assembly 38 does not require the second clothes mover 28 for support, such as when the basket assembly 38 is supported by the first laundry basket 18, configuration A does not have to include the second clothes mover 28. In this alternative configuration A, the second clothes mover 28 does not have to be present and the basket assembly 38 can be utilized with just the first clothes mover 30.

The user may select any of the configurations A, B, and C based on personal preference of utilizing the particular clothes mover 28 or 30, based on the amount and/or type of mechanical action implemented by the clothes movers 28 or 30, and/or based on characteristics of the laundry items to be treated, non-limiting examples of which include an amount of laundry to be treated, a size of the item(s) to be treated, an amount and/or type of mechanical energy to be applied to the laundry, and a fill level of liquid during treatment. For example, configuration B with the second clothes mover 28 can be utilized when the user desires to implement a high mechanical energy cycle or deep water cycle. Configuration C including an impeller-type clothes mover 30, without the post 32 extending upward into the treating chamber 20, can be utilized for washing large loads or a bulky item or when the user wishes to use a low water cycle.

Optionally, either of the configurations B or C can be selected by the user based on personal preference of one type of clothes mover 28 or 30 over another. For example, some users may prefer the agitator-type clothes mover 28 of configuration B, whereas other users may prefer the impeller-type clothes mover 30 of configuration C.

In one aspect of the present disclosure, the laundry treating system may be provided to the user in configuration C in which the laundry treating appliance 10 includes only the first clothes mover 30. The second clothes mover 28 and the removable basket assembly 38 can be offered to the user as a kit that can optionally be used with the laundry treating appliance 10. The kit can include the agitator post 32 and the removable basket assembly 38. The laundry treating appliance 10 can be configured for use as is in configuration C and optionally for use with the kit components—the agitator post 32 and the removable basket assembly 38. In this manner, the user has the option to customize the laundry treating system.

Figure 13:
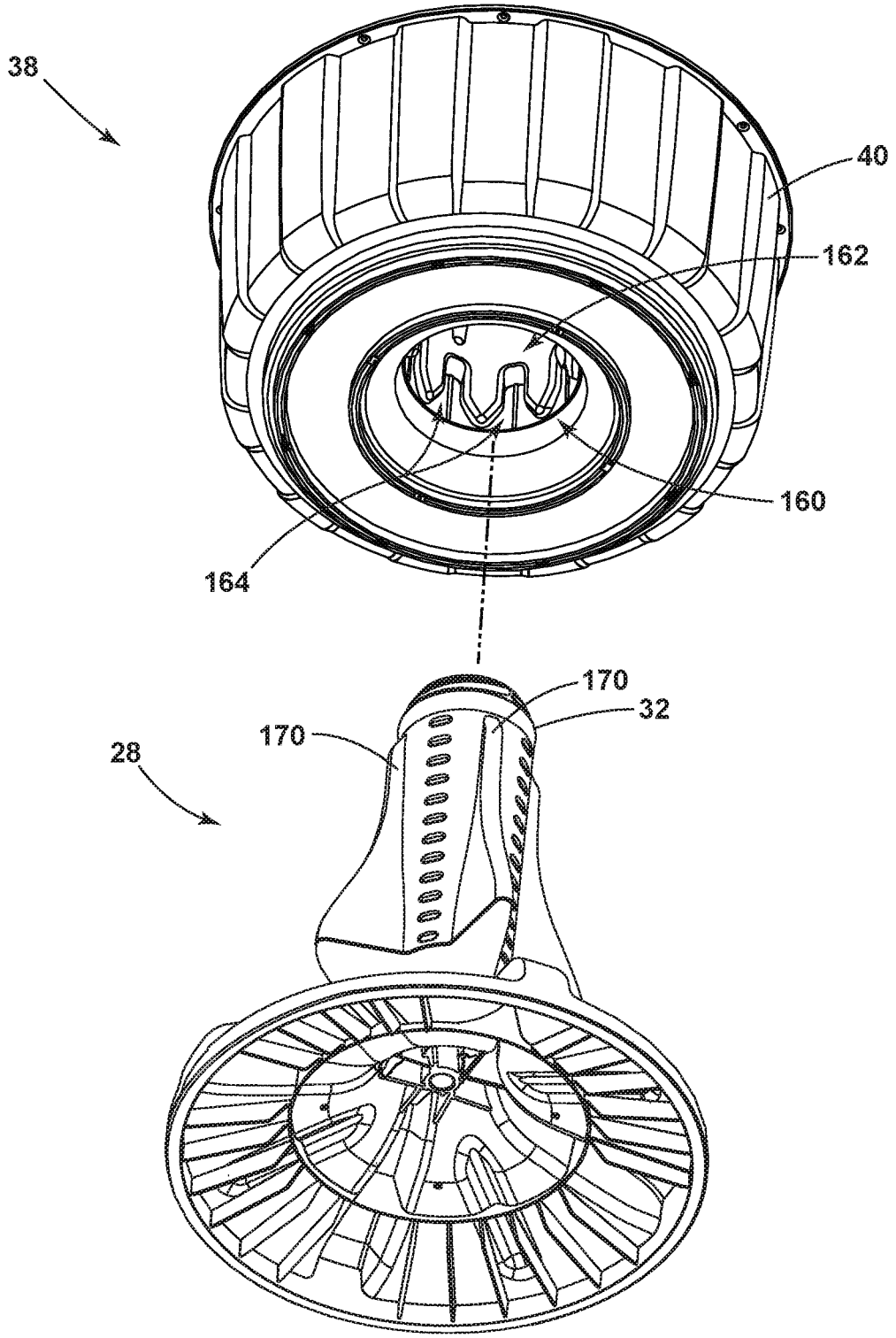
FIG. 13 is a perspective view of a removable basket assembly and clothes mover according to the present disclosure.

In another aspect of the disclosure, multiple different kits including different agitator posts 32 and/or different types of removable basket assemblies 38 can be made available to the user for customizing the laundry treating system. For example, agitator posts 32 having different features, such as different shapes or blade or vane configurations can be provided. For example, one option may include an agitator post 32 having an auger-style blade, as illustrated in FIG. 12, whereas another option may include an agitator post 32 having blades 170, as illustrated in FIG. 13. A kit according to an aspect of the disclosure includes any combination of clothes mover components, removable basket assemblies, and related components that allow the laundry treating system to be selectively configured by the user into different clothes mover configurations and single or dual basket configurations.

Different options of removable basket assemblies 38 can also be provided as part of a kit. For example, a kit may include a different style of removable basket assembly 38 based on the configuration of the agitator post 32, the manner in which the removable basket assembly 38 is mounted within the laundry treating appliance 10, optional features of the removable basket assembly 38, and/or features of the laundry treating appliance 10 (e.g. based on whether the laundry treating appliance has a separate liquid supply system for use with a removable basket assembly).

Figure 14:
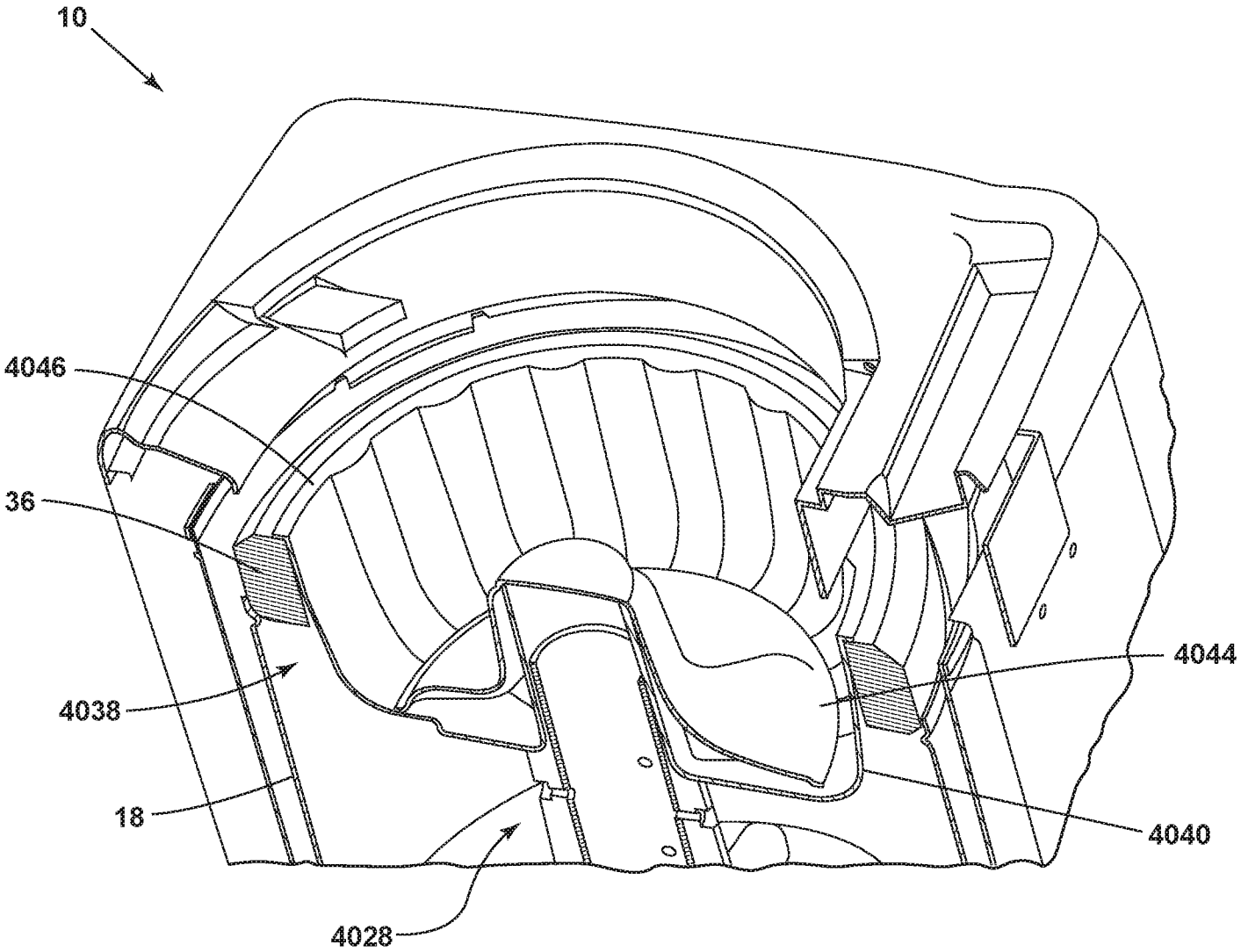
FIG. 14 is a perspective view of a removable basket assembly and clothes mover according to the present disclosure.

For example, a kit including the auger-style agitator post 32 of FIG. 12 may include a removable basket assembly 38 that is configured to be supported by the first laundry basket 18, such as the removable basket 4038 of FIG. 14. In another example, a kit may include the agitator post 32 and basket assembly 38 as illustrated in FIG. 13 in which the basket assembly 38 includes a transmitter 162 that is configured to be mounted directly onto the agitator post 32. In another aspect, kits may be provided with removable basket assemblies 38 having different options. For example, a kit may include a removable basket assembly 38 as illustrated in FIG. 1 in which the basket assembly 38 includes the dispensers 78 for supplying a treating chemistry to the second treating chamber 42 that are separate from the dispenser 76 that supplies treating chemistry to the main treating chamber 20. An alternative kit may include a removable basket assembly 38 that does not include separate dispensers. The different options of clothes movers and removable basket assemblies may be combined as desired to form any number of different kits for use with the laundry treating system of the present disclosure.

Figure 6:
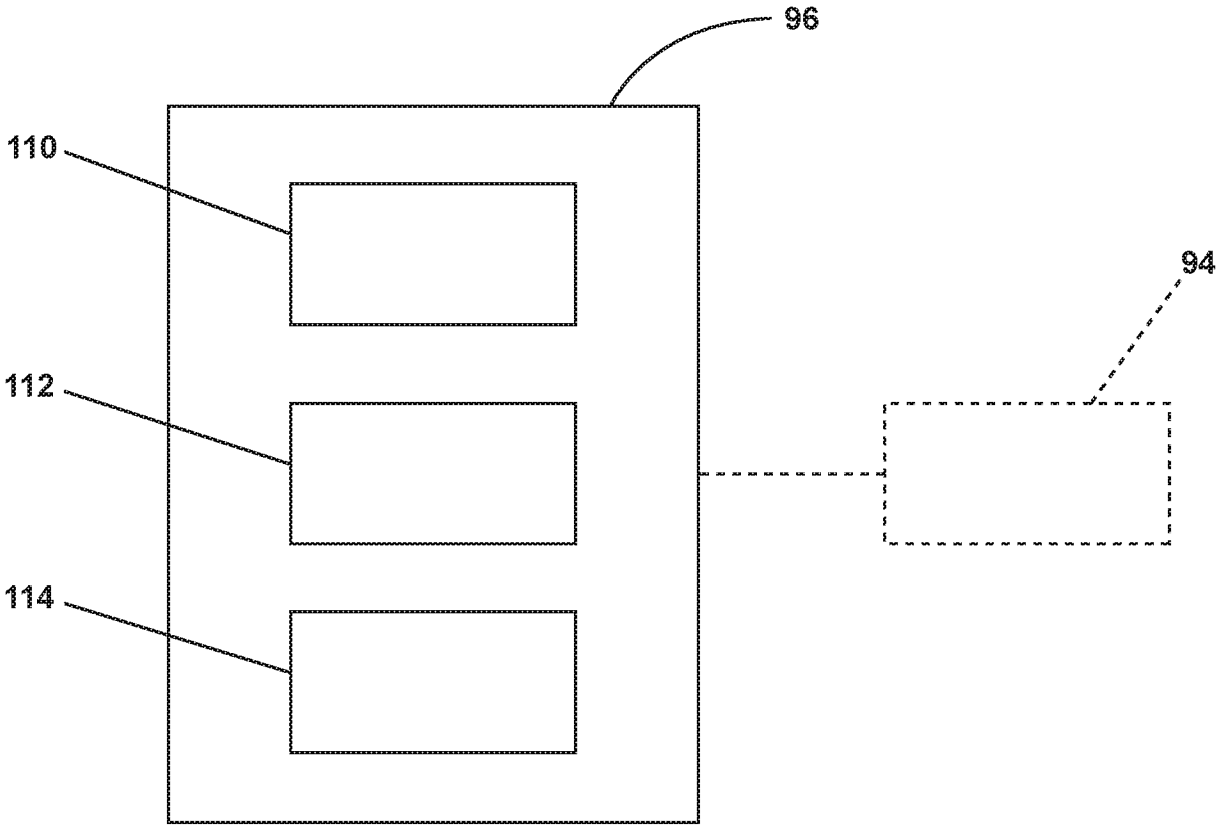
FIG. 6 is a schematic view of a user interface according the present disclosure.

FIG. 6 illustrates an example of a portion of a user interface 96 according to an aspect of the disclosure, configured to allow a user to provide input regarding which of the configurations A, B, or C of FIG. 4 is being utilized with the laundry treating appliance 10. The user interface 96 can include an indicator 110 for indicating configuration A, an indicator 112 for indicating configuration B, and an indicator 114 for configuration C. Each of the indicators 110, 112, and 114 can be actuatable by the user to communicate to the controller 94 which of the configurations A, B, and C will be present during the impending cycle of operation. Alternatively, the indicators 110, 112, and 114 themselves are not selectable and a separate selector actuator is provided for cycling through each of the options indicated by 110, 112, and 114.

In one example, the indicators 110, 112, and 114 are utilized to communicate to the controller 94 which configuration will be present during the impending cycle of operation. The user can utilize the indicators before or after assembling the desired configuration. Optionally, the controller 94 controls the information and selectable options available through the user interface 96 based on which of the indicators 110, 112, and 114 is selected by the user.

Alternatively, or additionally, the controller 94 can use the indicators 110, 112, and 114 to indicate to the user which configuration A, B, or C to utilize based on the user's selection of the impending cycle of operation and/or one or more selected cycle options. For example, if the user indicates through the user interface 96 that the laundry items to be washed include a bulky item (e.g. a comforter), the user interface 96 can be configured to communicate to the user through indicator 114 that configuration C is recommended for use in implementing the cycle of operation. The user can then remove the agitator post 32 and the basket assembly 38 (if they have not already been removed) and implement the selected cycle of operation using the recommended configuration. In another example, if the user indicates through the user interface 96 that the laundry load includes some delicate items, the controller 94 can be programmed to control the user interface 96 to indicate to the user through indicator 110 that configuration A with the basket assembly 38 is recommended.

The user interface 96 can include graphics and/or text to indicate to a user which configuration is recommended and/or to allow a user to communicate the configuration to the controller 94. In one example, the user interface 96 can include graphics representative of each of the possible configurations A, B, and C and the user interface 96 can be configured to illuminate the graphic corresponding to the recommended configuration. For example, each of the indicators 110, 112, and 114 can include a graphic representative of each configuration A, B, and C which is illuminated based on the user's selection and/or based on the configuration recommended by the controller 94.

Optionally, the controller 94 is provided with information regarding which of the configurations A, B, and C is present based on information from the sensor 106 to determine the presence/absence of the second clothes mover 28 and sensor 108 to determine the presence/absence of the removable basket assembly 38. The controller 94 may optionally use the information from the sensors 106, 108 to illuminate one of the indicators 110, 112, 114 to communicate to a user that a particular configuration is present.

Figure 7:
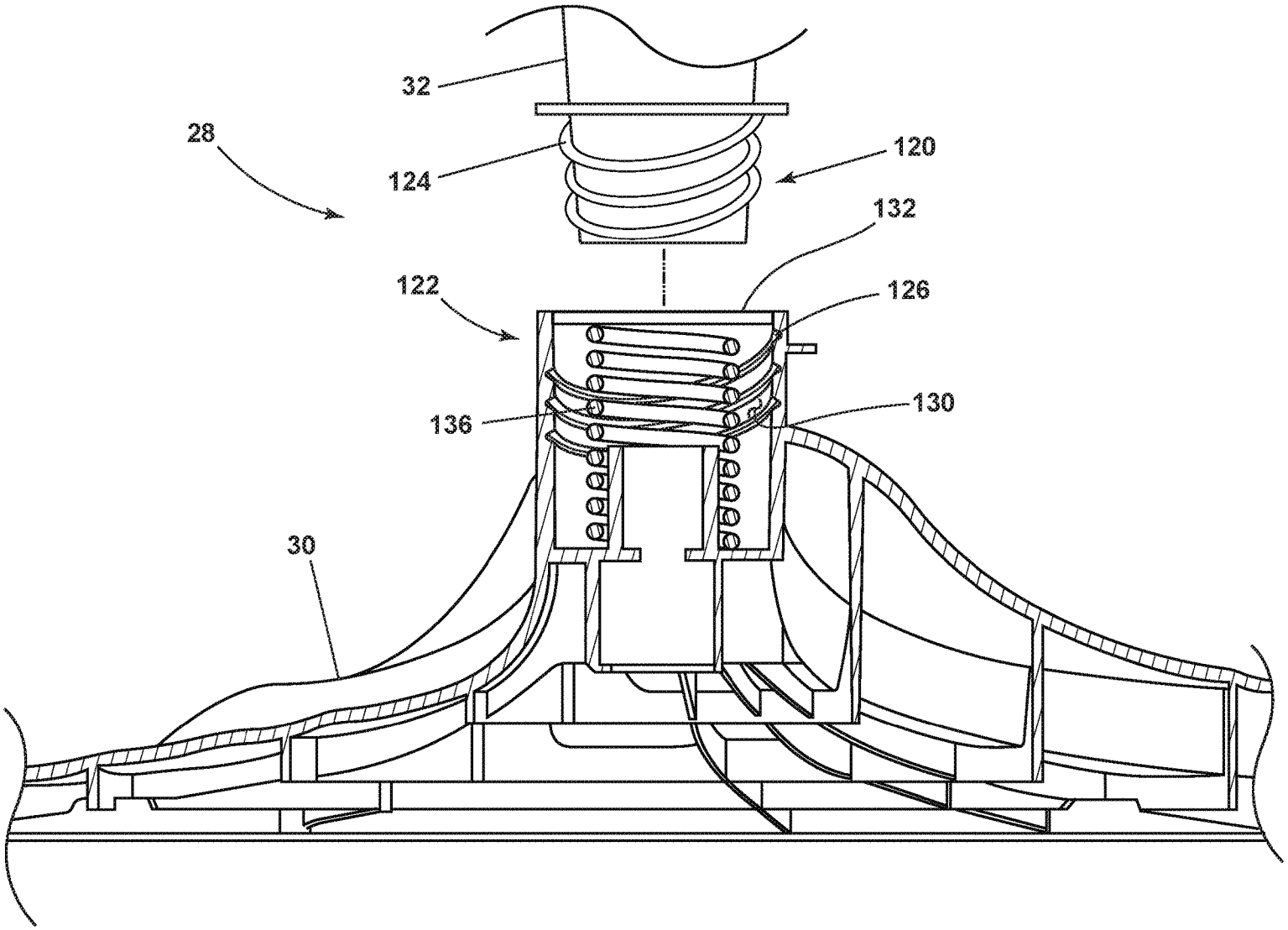
FIG. 7 is a partial cross-sectional view of a clothes mover according to the present disclosure.

Referring now to FIG. 7, the second clothes mover 28 can be formed by coupling an additional component, in this case the removable agitator post 32, to the first clothes mover 30 to form a new clothes mover. In one aspect, the first clothes mover 30 operates as a both a base for coupling with the agitator post 32 to form the second clothes mover 28 and an independent low profile clothes mover for use by itself. The agitator post 32 can include a first connector 120 that is configured to releasably couple with a second connector 122 provided on the first clothes mover 30. The first connector 120 includes threads 124 that are configured to be matingly received by corresponding threads 126 on the second connector 122 such that the agitator post 32 can be threaded onto the first clothes mover 30 to form the second clothes mover 28 and unthreaded from the first clothes mover 30 to provide the first clothes mover 30.

While the agitator post 32 is illustrated as forming the female portion of the coupling and the first clothes mover 30 is illustrated as forming the male portion, it is understood that for any of the clothes movers described in the present disclosure that the roles may be reversed and that the agitator post may form the male portion of the coupling and the first clothes mover may form the female portion.

Still referring to FIG. 7, the second connector 122 includes a socket 130 configured to receive the first connector 120 therein. The socket 130 optionally includes a cover 132 configured to provide access to the socket 130. In the embodiment of FIG. 7, the cover 132 is biased into a closed position, as illustrated, by a biasing element, such as a spring 136. The cover 132 can prevent access to the socket 130 when the agitator post 32 is not coupled to the first clothes mover 30. Closing the socket 130 can inhibit laundry items from falling into the socket 130 and prevent laundry items from being snagged or caught on the edges forming the socket 130, which could damage the laundry items.

To assemble the agitator post 32 onto the first clothes mover 30 to form the second clothes mover 28, the agitator post 32 is pressed against the cover 132 as the first connector 120 is inserted into the second connector 122. As the first connector 120 is threaded onto the second connector 122, the first connector 120 travels into the socket 130, pressing the cover 132 into the socket 130, against the bias of the spring 136. To disassemble the agitator post 32 from the first clothes mover 30 and form the second clothes mover 28, the first connector 120 is unthreaded and withdrawn from the socket 130. As the agitator post 32 is withdrawn, the cover 132 moves back into the closed position by expansion of the compressed spring 136. In this manner, the cover 132 is automatically moved into the closed position when the agitator post 32 is removed. The spring 136 may also apply a biasing force to the agitator 32 through the cover 132 to bias the agitator 32 away from the first clothes mover 30, which may facilitate disassembling the second clothes mover 28.

In another aspect of the present disclosure, cover 132 may be a removable cover which may or may not be biased into the closed position. For example, the cover 132 may be coupled to the second connector 122 by a threaded connection, a snap-fit connection, or an interference fit. To assemble the agitator post 32, the user removes the cover 132 and sets the cover aside prior to coupling the agitator post 32 to the first clothes mover 30. In one example, the agitator post 32 can include a compartment configured to store the cover 132 when not in use. In still another example, the cover 132 may be formed of a flexible, resilient material, such as natural or synthetic rubber, that closes the socket 130 in its initial position, but bends out of the way as the first connector 120 is inserted into the second connector 122. When the agitator post 32 is uncoupled, the flexible, resilient material returns to its initial position, closing the socket 130.

FIGS. 8, 9A-B, and 10 illustrate an exemplary second and first clothes mover 1028 and 1030 for use in the laundry system described herein that is similar to the second and first clothes movers 28, 30 of FIG. 7, but differs in some aspects, such as the manner in which the agitator post 1032 is coupled with the first clothes mover 1030. Therefore, elements of the second and first clothes movers 1028, 1030 that are similar to those of the second and first clothes movers 28 and 30 are labeled with the prefix 1000.

Figure 8:
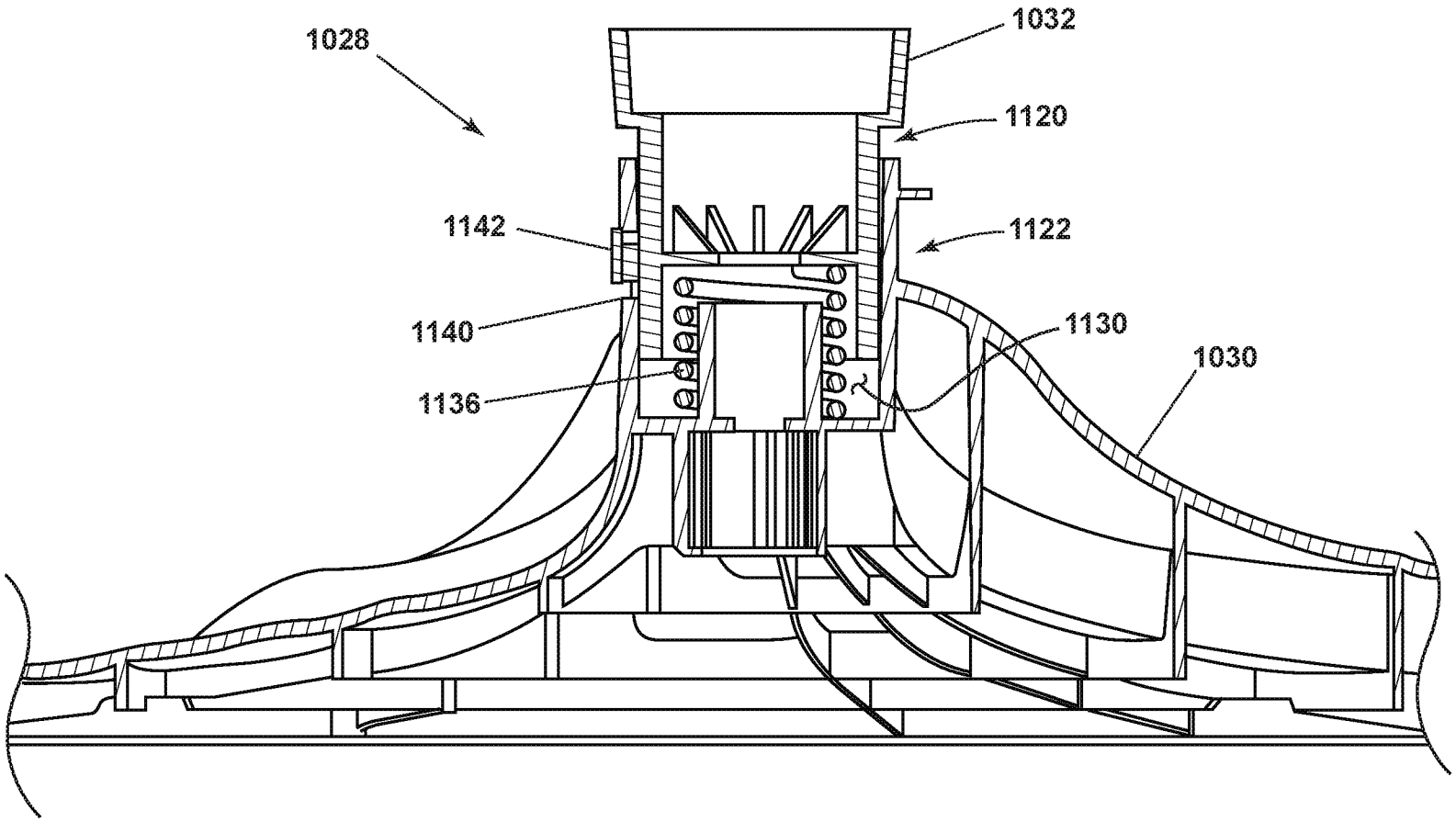
FIG. 8 is partial cross-sectional view of a clothes mover according to the present disclosure.

In the embodiment of FIG. 8, the agitator post 1032 is coupled to the first clothes mover 1030 to form the second clothes mover 1028 using a bayonet mount-type connection. The second connector 1122 includes at least one channel 1140 configured to receive a pin 1142 carried by the first connector 1120. The second connector 1122 optionally includes a biasing element 1136 within the socket 1130 which is compressed within the socket 1130 when the agitator post 1032 is coupled with the first clothes mover 1030, as illustrated in FIG. 8.

Figure 9B:
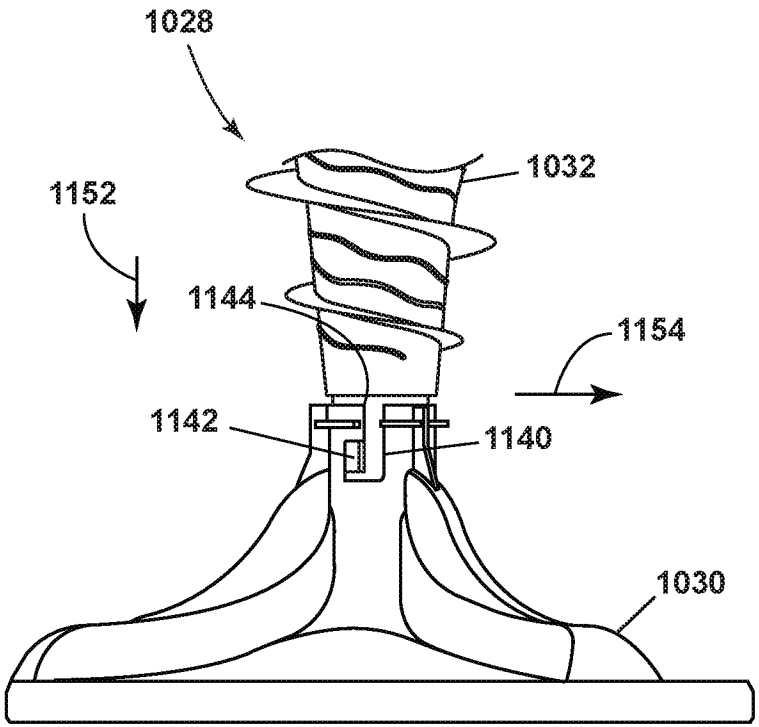
FIG. 9B is a perspective view of the clothes mover of FIG. 8 according to the present disclosure.
Figure 9A:
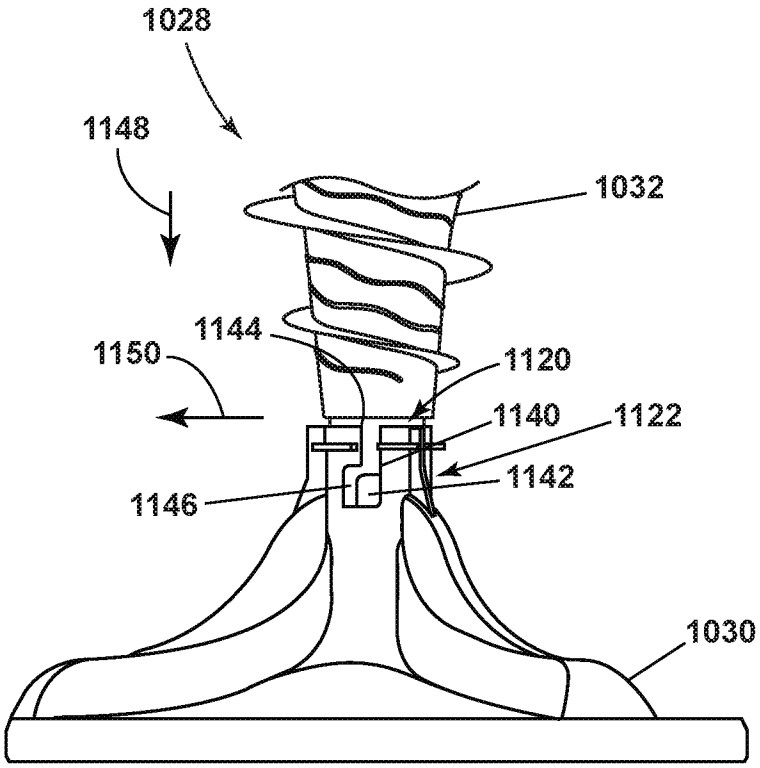
FIG. 9A is a perspective view of the clothes mover of FIG. 8 according to the present disclosure.

Referring now to FIGS. 9A-B, to assemble the second clothes mover 1028, the agitator post 1032 is aligned with the first clothes mover 1030 such that the pin 1142 is aligned with an opening 1144 of the channel 1140. The agitator post 1032 is moved toward the first clothes mover 1030, as illustrated by arrow 1148, to insert the first connector 1120 into the second connector 1122. As the first connector 1120 is inserted into the second connector 1122, the pin 1142 travels to an end of the channel 1140. The agitator post 1032 is then rotated, as illustrated by arrow 1150, to move the pin 1142 into a lock portion 1146 of the channel 1140, as illustrated in FIG. 9B.

When the agitator post 1032 is coupled with the first clothes mover 1030, the spring 1136 (FIG. 8) biases the agitator post 1032 away from the first clothes mover 1030, facilitating maintaining the pin 1142 in the lock portion 1146. The spring bias applies a force that presses the agitator post 1032, and thus the pin 1142, upward, which presses the pin 1142 against the wall forming the lock portion 1146. Biasing the pin 1142 against the wall of the lock portion 1146 may inhibit unintended rotation of the agitator post 1032 relative to the first clothes mover 30 during a cycle of operation into a position in which the pin 1142 is aligned with the channel opening 1144, which could result in unintended uncoupling of the agitator post 1032 from the first clothes mover 1030.

To uncouple the agitator post 1032 from the first clothes mover 1030 in FIG. 9B, a downward pressure is applied to the agitator post 1032, as illustrated by arrow 1152 to disengage the pin 1142 from the channel wall forming the lock portion 1146. The agitator post 1032 is then rotated, as illustrated by arrow 1154, to align the pin 1142 with the channel opening 1144, as illustrated in FIG. 9A. When the pin 1142 is aligned with the channel opening 1144, the agitator post 1032 can be withdrawn in the opposite direction of arrow 1148 of FIG. 9A. Because the spring 1136 (FIG. 8) is compressed when the agitator post 1032 is coupled with the first clothes mover 1030, the spring 1136 provides a biasing force that presses the agitator post 1032 away from the first clothes mover 1030, which may facilitate withdrawing and uncoupling of the agitator post 1032. In another aspect of the disclosure, the spring 1136 is not present. Alternatively, the spring 1136 is carried by the agitator post 1032.

Figure 10:
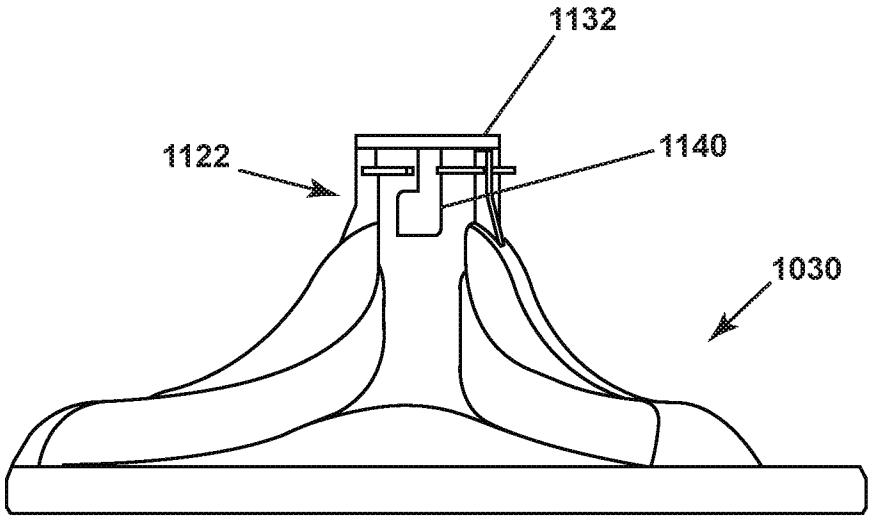
FIG. 10 is a perspective view of a clothes mover according to the present disclosure.

Once the agitator post 1032 is uncoupled from the first clothes mover 1030, the agitator post 1032 can be set aside, leaving only the first clothes mover 1030, as illustrated in FIG. 10, for use in the first laundry basket 18. Optionally, the first clothes mover 1030 may be provided with a cover 1132 for closing the opening to the socket 1130 of the second connector 1122 (FIG. 8). In one example, the cover 1132 may be in the form of a plug that is inserted into the socket 1130 and optionally covers the channel 1140. In another example, the cover 1132 may be in the form of a cap that fits over an exterior of the second connector 1122, optionally covering the channel 1140. The cover may be secured to the second connector 1122 using any suitable type of connection, non-limiting examples of which include a snap-fit, a threaded connection, or an interference fit. In still another example, the cover may be formed of a flexible, resilient material, such as natural or synthetic rubber, that closes the socket 1130 in its initial position, but bends out of the way as the first connector 1120 is inserted into the second connector 1122. When the agitator post 1032 is uncoupled, the material returns to its initial position closing the socket 1130.

Figure 11:
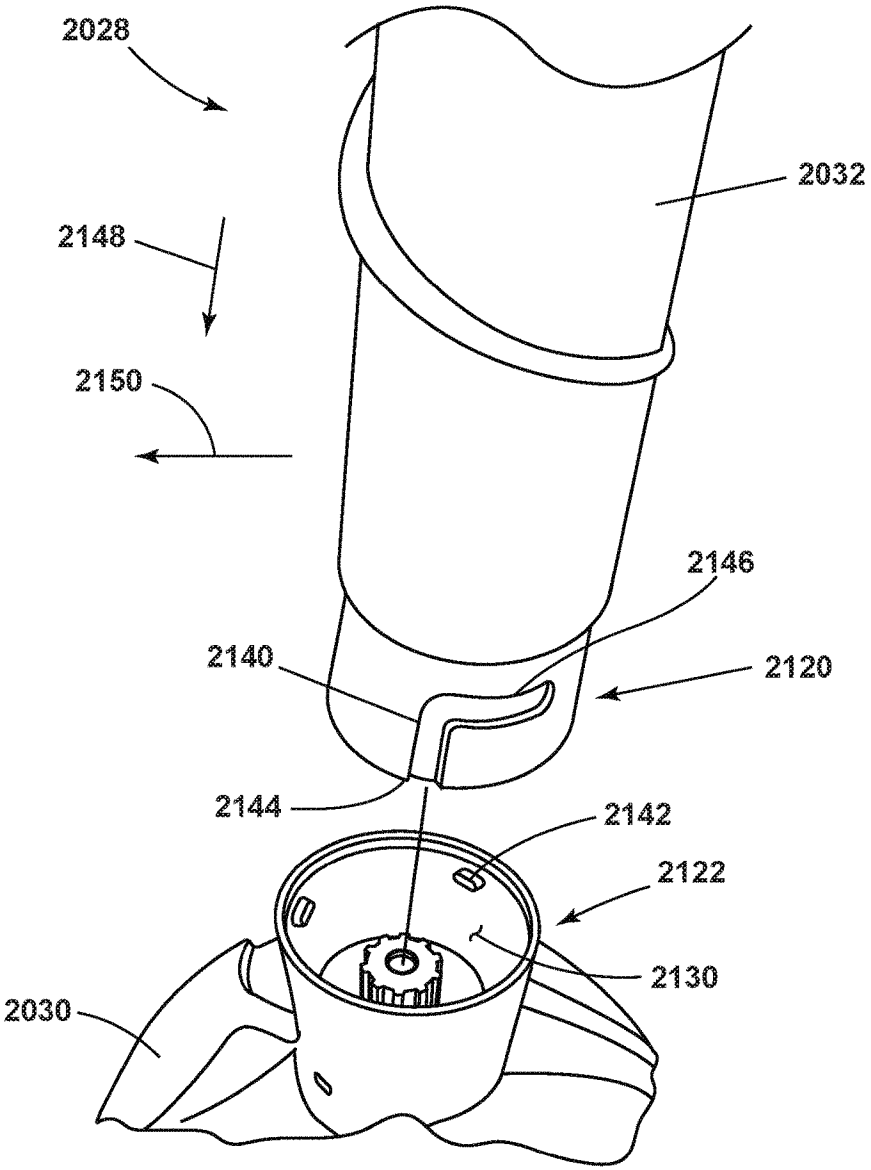
FIG. 11 is a perspective view of a clothes mover according to the present disclosure.

FIG. 11 illustrates another exemplary second and first clothes mover 2028 and 2030 for use in the laundry system described herein that is similar to the second and first clothes movers 28, 30 of FIG. 7 and 1028, 1030 of FIG. 8, but differs in some aspects, such as the manner in which the agitator post 2032 is coupled with the first clothes mover 2030. Therefore, elements of the second and first clothes movers 2028, 2030 that are similar to those of the second and first clothes movers 28, 30 and 1028, 1030 are labeled with the prefix 2000.

In the embodiment of FIG. 11, the agitator post 2032 is coupled to the first clothes mover 2030 to form the second clothes mover 2028 using a bayonet mount-type connection. The first connector 2120 includes at least one channel 2140 configured to receive a pin 2142 carried by the second connector 2122 that projects into the socket 2130. To assemble the second clothes mover 2028, the agitator post 2032 is aligned with the first clothes mover 2030 such that the pin 2142 is aligned with the opening 2144 of the channel 2140. The agitator post 2032 is moved toward the first clothes mover 2030, as illustrated by arrow 2148, to insert the first connector 2120 into the second connector 2122. As the first connector 2120 is inserted into the second connector 2122, the pin 2142 travels to the end of the channel 2140. The agitator post 2032 is then rotated, as illustrated by arrow 2150, to move the pin 2142 into the lock portion 2146 of the channel 2140. The process can be performed in reverse to uncouple and remove the agitator post 2032 to form the first clothes mover 2030.

Optionally, one of the first or second connectors 2120, 2122 can include a biasing element to facilitate securing the coupled agitator post 2032 in place and to facilitate disassembly of the agitator post 2032 in a manner similar to that described above with respect to the first and second connectors 1120, 1122 of FIG. 8. In one aspect of the present disclosure, the first clothes mover 2030 can be provided with a cover similar to any of those described with respect to the first clothes movers 30, 1030 of FIGS. 7 and 10.

FIG. 12 illustrates another exemplary second and first clothes mover 3028 and 3030 for use in the laundry system described herein that is similar to the second and first clothes movers 28, 30 of FIG. 7 and 1028, 1030 of FIG. 8, but differs in some aspects, such as the manner in which the agitator post 3032 is coupled with the first clothes mover 3030. Therefore, elements of the second and first clothes movers 3028, 3030 that are similar to those of the second and first clothes movers 28, 30 and 1028, 1030 are labeled with the prefix 3000.

The first connector 3120 can include a set of grooves and ribs 3124 configured to mate with a corresponding set of grooves and ribs 3126 provided on the second connector 3122. The sets of grooves and ribs 3124, 3126 can be provided to facilitate aligning the agitator post 3032 for coupling with the first clothes mover 3130 and/or to provide structural support to the agitator post 3032 in use during a cycle of operation. The first connector 3120 further includes a lock element 3142 that mates with a corresponding aperture 3140 to secure the agitator post 3032 to the first clothes mover 3030.

In one aspect, the lock element 3142 includes a pair of resilient prongs having outwardly extending legs that flex toward one another as the lock element 3142 is inserted into the aperture 3140 and then resiliently flex back toward their original position once the legs pass through the aperture 3140. The legs engage the surface around the aperture 3140, inhibiting withdrawal of the first connector 3120 from the second connector 3122. To uncouple the agitator post 3032, the prongs are pressed together to allow the legs to pass back through the aperture 3140 as the first connector 3120 is withdrawn from the second connector 3122. Optionally, the position of the lock element 3142 and the aperture 3140 on the first and second connectors 3120, 3122 is reversed. The first clothes mover 3130 can optionally include a cover (not shown) in a manner similar to that described for other first clothes movers of the present disclosure.

Optionally, the first clothes mover 3130 or the agitator post 3032 can be configured to provide the user with feedback when the agitator post 3032 is coupled to the first clothes mover 3130. The feedback can be in the form of audible, visual, and/or tactile feedback. In one example, one of the first and/or second connectors 3120, 3122 is configured to provide an audible "click" or tactile vibration when coupled together. In another example, one of the first and/or second connectors 3120, 3122 can be provided with a sensor communicably coupled with the controller 94, such as the sensor 108 described above with respect to FIG. 5. The sensor provides an output to the controller 94 when the first and second connectors 3120, 3122 are coupled, indicating that the agitator post 3032 is coupled with the first clothes mover 3130. The controller 94 can be configured to provide visual feedback to the user through user interface 96 or an audible feedback, such as a chime, to indicate to the user that the agitator post 3032 is coupled with the first clothes mover 3130.

Referring now to FIG. 13, according to one aspect of the present disclosure, the second laundry basket 40 can be supported by the agitator post 32 of the second clothes mover 28. The second laundry basket 40 includes a central aperture 160 that is configured to receive a transmitter 162 in a manner similar to that described in Applicant's co-pending application, application Ser. No. 15/651,589, entitled "Laundry Treating Appliance with Removable Basket," filed Jul. 17, 2017, the contents of which are incorporated herein by reference in their entirety. The transmitter 162 includes a set of recesses 164 on an interior thereof that are configured to receive a set of blades 170 on the agitator post 32. The transmitter 162 can support the second laundry basket 40 within the laundry treating appliance 10. Optionally, the transmitter 162 is configured to transmit torque and/or rotational movement from the second clothes mover 28 to the auxiliary clothes mover 44 (FIG. 1) of the second laundry basket 40.

In another example, the second laundry basket 40 can be configured to be supported by the agitator post 32 without the transmitter 162. The central aperture 160 can be shaped to receive an upper portion of the agitator post 32 to support the second laundry basket 40 relative to the first laundry basket 18. The second laundry basket 40 in this configuration may be entirely supported by the agitator post 32 or optionally at least partially supported by the first laundry basket 18 and/or the balance ring 36, in addition to the agitator post 32.

FIG. 14 illustrates another example of a removable basket assembly 4038 and second clothes mover 4028 that can be utilized with the laundry treating appliance 10 according to another aspect of the present disclosure. The removable basket assembly 4038 and the second clothes mover 4028 are similar to the removable basket assembly 38 and second clothes mover 28 of FIG. 1, but differ in some aspects, such as the manner in which the removable basket assembly 4038 is supported within the laundry treating appliance. Therefore, aspects of the removable basket assembly 4038 and second clothes mover 4028 similar to those of FIG. 1 are labeled with the prefix 4000.

In the embodiment of FIG. 14, the second laundry basket 4040 includes a flange 4046 that is supported on the balance ring 36 and/or an upper portion of the first laundry basket 18 to support the removable basket assembly 4038 relative to the first laundry basket 18. The balance ring 36 may be any type of balance ring known in the art, non-limiting examples of which include a solid balance ring, a ball balance ring, and a fluid balance ring. An exemplary configuration for supporting the removable basket assembly is described in U.S. Pub. No. 2016/0222567 to Ramasco et al., filed Oct. 23, 2015, now U.S. Pat. No. 9,863,078, issued Jan. 9, 2018, entitled "Coupling System of Removable Compartment for Appliances," the contents of which are incorporated herein by reference in their entirety.

The removable basket assembly 4038 may optionally be supported by the second clothes mover 4028. In configurations in which the removable basket assembly 4038 is not supported by the second clothes mover 4028, then the laundry treating system can include a fourth configuration in which the first clothes mover 30 is present within the first laundry basket 18, without the agitator post coupled, and the removable basket assembly 4038 is present.

Figure 15:
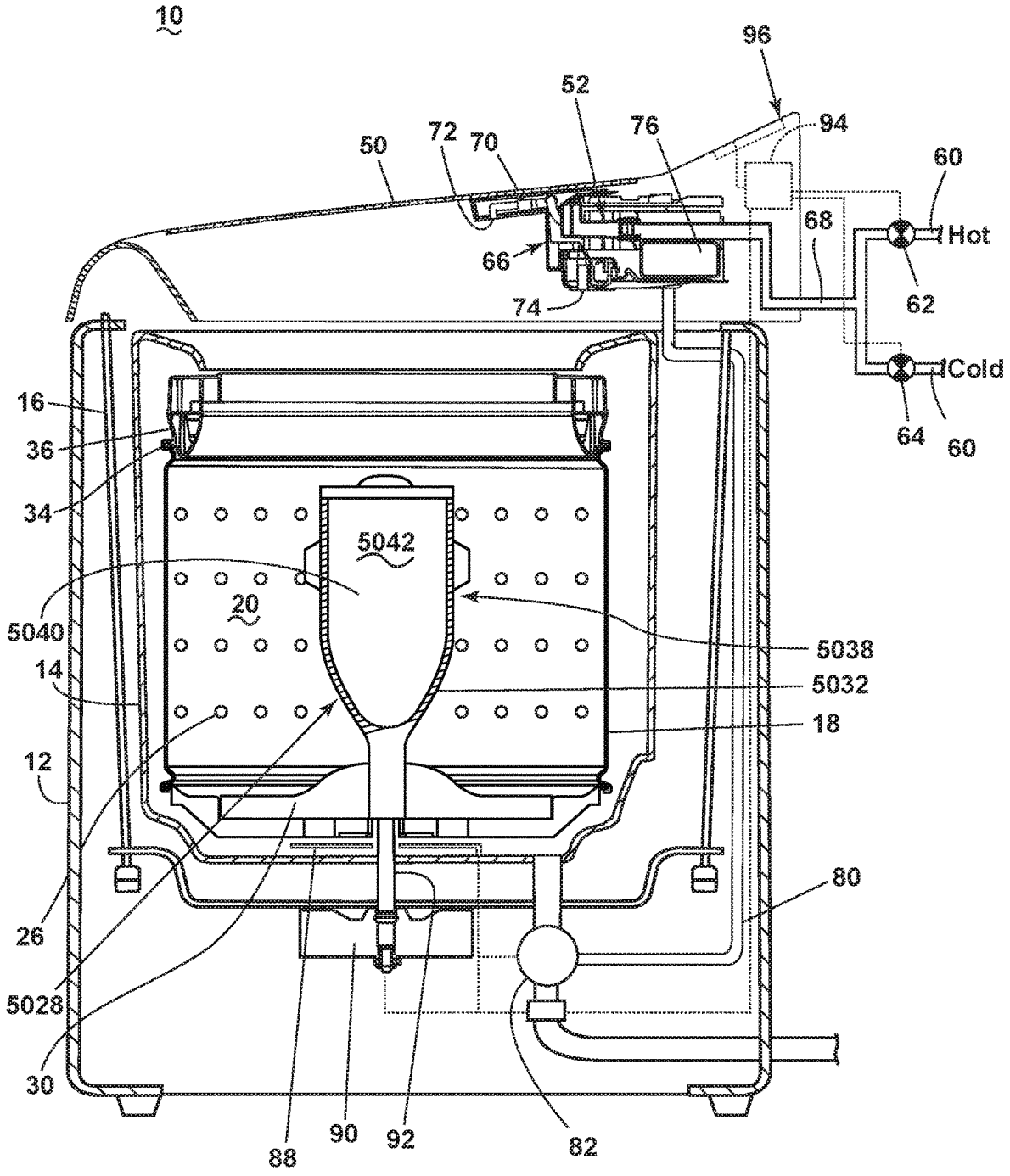
FIG. 15 is a schematic view of a laundry treating appliance in the form of a washing machine having a first basket and a removable basket assembly in a fourth configuration according to the present disclosure.

FIG. 15 illustrates another example of a removable basket assembly 5038 that is similar to the removable basket assembly 38 of FIG. 1, but differs in some aspects, such as the manner in which the removable basket assembly 5038 is supported relative to the first laundry basket 18. In the embodiment of FIG. 15, the removable basket assembly 5038 is integrally formed with the removable agitator post 5032. Therefore, elements of the removable basket assembly 5038 and agitator post 5032 similar to those of the removable basket assembly 38 and agitator post 32 are labeled with the prefix 5000.

The removable basket assembly 5038 is integrally formed within an interior of the removable agitator post 5032. The agitator post 5032 can be removably coupled with the first clothes mover 30 in a manner similar to those disclosed herein with respect to any of the second clothes movers 28, 1028, 2028, and 3028. The removable basket assembly 5038 provides a second laundry basket 5040 for use in treating a smaller load within the first laundry basket 18. For example, the user may place small items and/or delicate items within the second laundry basket 5040 to separate the items from the remaining items being treated in the first laundry basket 18. Because the second treating chamber 5042 is exposed to the same fluid present in the first treating chamber 20, the removable basket assembly 5038 can be utilized with laundry treating appliances that do not include a dispensing system capable of supplying fluid and treating chemistry to the second treating chamber 5042 independent of the first treating chamber 20. When the removable basket assembly 5038 is coupled with the first clothes mover 30, the removable basket assembly 5038 provides a second clothes mover 5028 in addition to providing a second laundry basket 5040.

Figure 16:
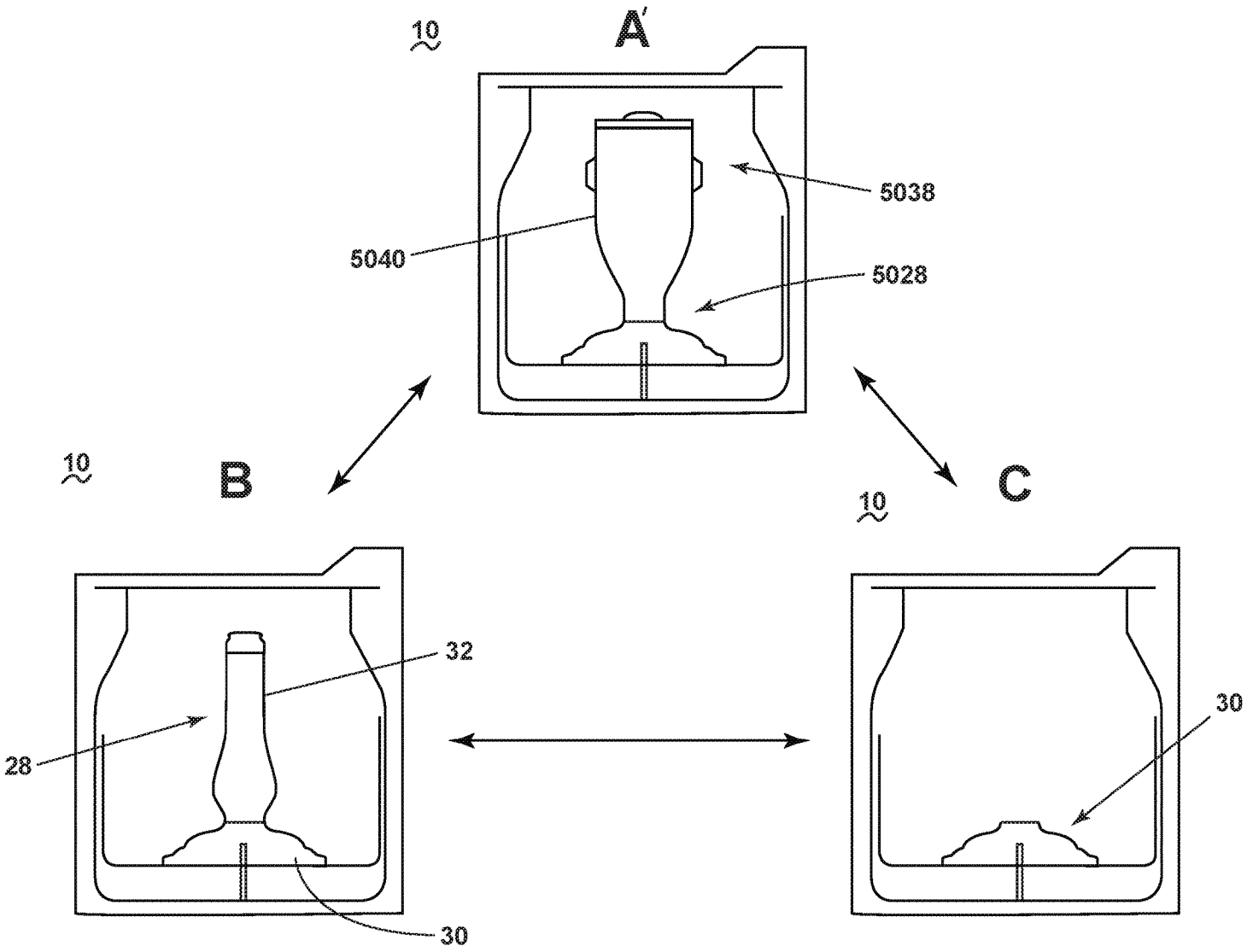
FIG. 16 is a schematic view of a laundry treating system according to the present disclosure.

Referring now to FIG. 16, the removable basket assembly 5038 can be used with the laundry treating system of FIG. 4 to provide an alternative configuration A' that provides a user with the option to customize the laundry treating appliance 10 to include a second laundry basket 5040. The removable laundry basket assembly 5038 can be coupled with the first clothes mover 30 in a manner similar to the agitator post 32 to allow a user to selectively switch between any of the configurations A', B, or C. Optionally, the laundry treating system can be configured to allow the user to selectively switch between any of the configurations A' of FIG. 16 and A, B, and C of FIG. 4.

The removable basket assembly 5038 can be provided alone or along with the agitator post 32 as a kit for use with the laundry treating appliance 10 of configuration C. The user can purchase and use the laundry treating appliance 10 of configuration C with or without the kit.

Figure 17:
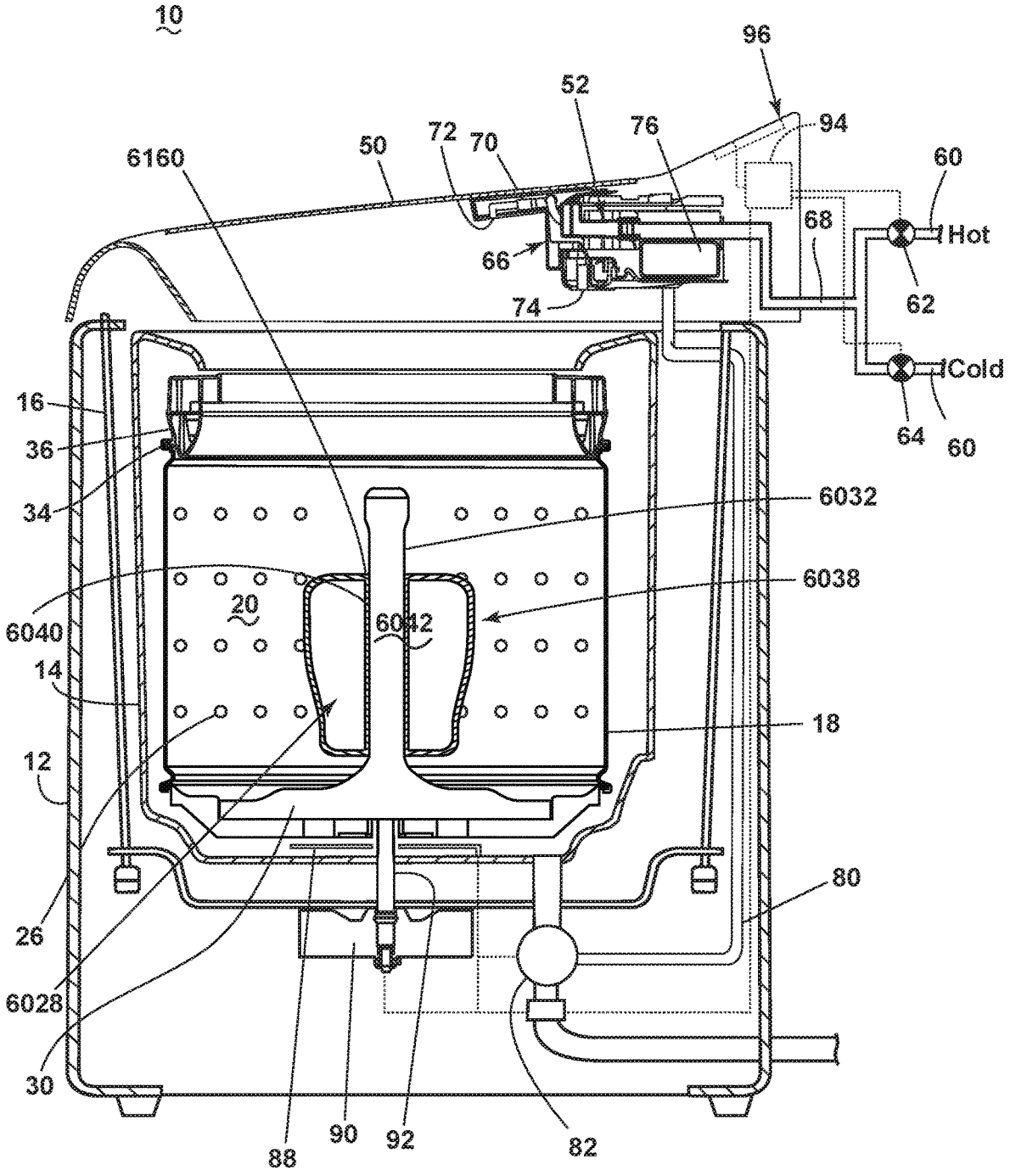
FIG. 17 is a schematic view of a laundry treating appliance in the form of a washing machine having a first basket and a removable basket assembly in a fifth configuration according to the present disclosure.

FIG. 17 illustrates another aspect of the disclosure in which the removable basket assembly 6038 is removably supported on the agitator post 6032. The removable basket assembly 6038 is similar to the removable basket assembly 38 of FIG. 1 and 5038 of FIG. 15, but differs in some aspects, such as the manner in which the removable basket assembly 6038 is supported relative to the first laundry basket 18. In the embodiment of FIG. 17, the removable basket assembly 6038 is removably mounted to the agitator post 5032. Therefore, elements of the removable basket assembly 6038 and agitator post 6032 similar to those of the removable basket assembly 38 and agitator post 32 are labeled with the prefix 6000.

The removable basket assembly 6038 is configured to be received by the agitator post 6032 and to be supported within the first treating basket 18. The removable basket assembly 6038 provides a second laundry basket 6040 for use in treating a smaller load within the first laundry basket 18. For example, the user may place small items and/or delicate items within the second laundry basket 6040 to separate the items from the remaining items being treated in the first laundry basket 18. Because the second treating chamber 6042 is exposed to the same fluid present in the first treating chamber 20, the removable basket assembly 6038 can be utilized with laundry treating appliances that do not include a dispensing system capable of supplying fluid and treating chemistry to the second treating chamber 6042 independent of the first treating chamber 20.

The removable basket assembly 6038 can include a central socket 6160 configured to receive the agitator post 6032 and allow the removable basket assembly 6038 to be slid over the agitator post 6032 into place. In one example, the agitator post 6032 can be the same as the agitator post 32 and the central socket 6160 can include an interior surface that mates with the shape of the agitator post 32, allowing the second laundry basket 6040 to be slid into place. One example of a removable basket assembly that slides over the central column and vanes of an agitator post is disclosed in Brazilian Industrial Design Patent Application No. DI7003246-7 F, filed Aug. 18, 2010, and published on Oct. 4, 2011, entitled "Configuração Aplicada A Cesto Acessório Para Máquina de Lavar," the contents of which are incorporated herein by reference in their entirety.

Alternatively, the agitator post 6032 can be specifically configured for use with the removable basket assembly 6038. For example, the agitator post 6032 can be free of vanes or blades to facilitate receipt of the agitator post 6032 within the central socket 6160. In this aspect, the agitator post 6032 can be removably coupled with the first clothes mover 30 in a manner similar to those disclosed herein with respect to any of the second clothes movers 28, 1028, 2028, and 3028. When the removable basket assembly 6038 is coupled with the first clothes mover 30, the removable basket assembly 6038 provides a second clothes mover 6028 in addition to providing a second laundry basket 6040.

Figure 18:
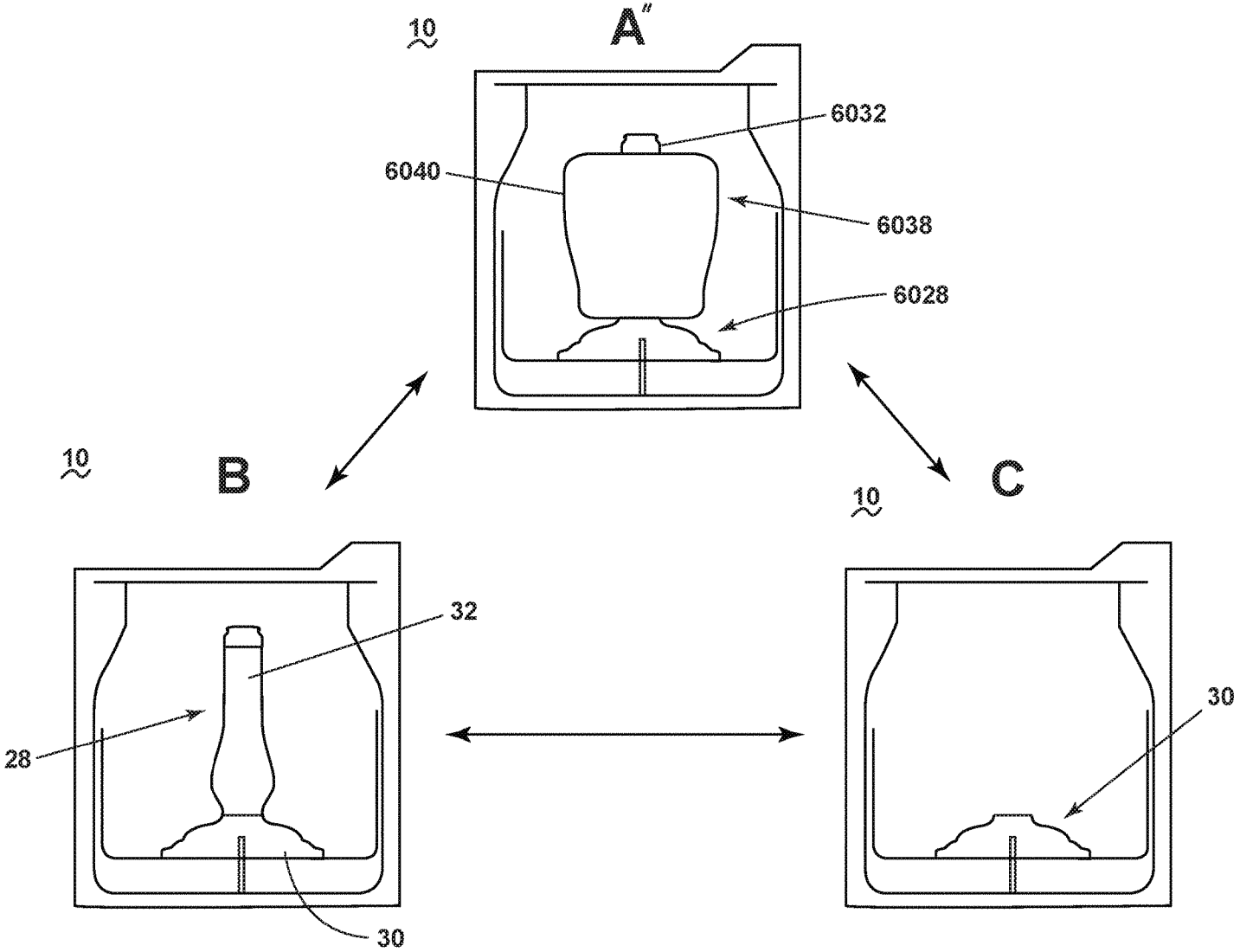
FIG. 18 is a schematic view of a laundry treating system according to the present disclosure.

Referring now to FIG. 18, the removable basket assembly 6038 can be used with the laundry treating system of FIG. 4 to provide an alternative configuration A" that provides a user with the option to customize the laundry treating appliance 10 to include a second laundry basket 6040. When the removable basket assembly 6038 is configured to be received on the agitator post 32, the user can selectively switch between any of the configurations A", B, and C by coupling the agitator post 32 to the first clothes mover 30 and optionally adding the removable basket assembly 6038. In another aspect, when the removable basket assembly 6038 requires a specific agitator post 6032 for supporting the basket assembly 6038 within the first treating basket 18, the user can switch between the configurations A", B, and C by coupling/uncoupling the agitator 32 and coupling/uncoupling the agitator 6032 and removable basket assembly 6038 with the first clothes mover 30. Optionally, the laundry treating system can be configured to allow the user to selectively switch between any of the configurations A" of FIG. 18, A' of FIG. 16 and A, B, and C of FIG. 4.

The removable basket assembly 6038 can be provided along with the agitator post 32, and optionally with the agitator post 6032, as a kit for use with the laundry treating appliance 10 of configuration C. The user can purchase and use the laundry treating appliance 10 of configuration C with or without the kit.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. For example, any of the features described with respect to the first and second clothes movers 30 and 28, 1030 and 1028, 2030 and 2028, and 3030 and 3028 can be mixed and matched and used interchangeably with one another. Features described with respect to the first clothes mover 30, 1030, 2030, and 3030 can be used interchangeably with any of the other first clothes movers 30, 1030, 2030, and 3030. Features described with respect to the second clothes mover 28, 1028, 2028, and 3028 can be used interchangeably with any of the other second clothes movers 28, 1028, 2028, and 3028.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A laundry treating system comprising:

a laundry treating appliance;

a first basket disposed within the laundry treating appliance for receiving a first laundry load for treatment;

a first clothes mover disposed in the first basket and comprising a first connector;

a second clothes mover removably coupled to the first clothes mover and comprising a second connector configured to releasably couple with the first connector, wherein one of the first or second connectors comprises a socket configured to receive the other of the first or second connectors and a cover selectively moveable between a closed position and an open position to allow access to the socket, wherein the cover is biased into the closed position; and a second basket removably coupled to the second clothes mover;

wherein the laundry treating system is user configurable between:

(a) a first configuration in which the second clothes mover is coupled to the first clothes mover and the second basket is coupled to the second clothes mover for receiving a second laundry load for treatment, the one of the first or second connectors received within the socket and pressing the cover into the socket to the open position to allow access to the socket;

(b) a second configuration in which the second clothes mover is coupled to the first clothes mover and the second basket is decoupled from the laundry treating appliance, the one of the first or second connectors received within the socket and pressing the cover into the socket to the open position to allow access to the socket; and (c) a third configuration in which both the second clothes mover and the second basket are decoupled from the laundry treating appliance, the one of the first or second connectors withdrawn from the socket and the cover biased into the closed position to prevent access to the socket.

2. The laundry treating system of claim 1 wherein the first clothes mover comprises a low profile impeller.

3. The laundry treating system of claim 1 wherein the second clothes mover comprises a vertically oriented agitator post.

4. The laundry treating system of claim 1 wherein the second basket is at least partially disposed within the first basket in the first configuration.

5. The laundry treating system of claim 1, further comprising a controller configured to receive an input indicative of at least one of the first, second, or third configurations and control the laundry treating appliance to execute a cycle of operation based on the input.

6. The laundry treating system of claim 5, further comprising at least one sensor configured to provide an output indicative of at least one of the first clothes mover, the second clothes mover, or the second basket, and wherein the input indicative of at least one of the first, second, or third configurations is based on the at least one sensor output.

7. The laundry treating system of claim 1 wherein the second basket is removably coupled to the second clothes mover such that a rotational force is transferred from the second clothes mover to the second basket.

8. The laundry treating system of claim 1 wherein the first basket comprises a balance ring and wherein the second basket is removably coupled to the balance ring.

9. A kit for a laundry treating appliance having a first basket disposed within the laundry treating appliance for receiving a first laundry load for treatment, the kit comprising:

a first clothes mover disposed in the first basket and comprising a first connector;

a second clothes mover capable of being removably coupled to the first clothes mover and comprising a second connector configured to releasably couple with the first connector, wherein one of the first or second connectors comprises a socket configured to receive the other of the first or second connectors and a cover selectively moveable between a closed position and an open position to allow access to the socket, and wherein the cover is biased into the closed position; and a second basket capable of being removably coupled to the second clothes mover, wherein the kit is user configurable between:

(a) a first configuration in which the second clothes mover is coupled to the first clothes mover and the second basket is coupled to the second clothes mover for receiving a second laundry load for treatment, the one of the first or second connectors received within the socket and pressing the cover into the socket to the open position to allow access to the socket;

(b) a second configuration in which the second clothes mover is coupled to the first clothes mover and the second basket is decoupled from the laundry treating appliance, the one of the first or second connectors received within the socket and pressing the cover into the socket to the open position to allow access to the socket; and (c) a third configuration in which both the second clothes mover and the second basket are decoupled from the laundry treating appliance, the one of the first or second connectors withdrawn from the socket and the cover biased into the closed position to prevent access to the socket.

10. The kit of claim 9 wherein the second clothes mover comprises an agitator post.

11. The kit of claim 9 wherein the second connector is provided on the second clothes mover.

12. The kit of claim 9 wherein one of the first or second connectors comprises a plurality of ribs configured to mate with corresponding grooves disposed on the other of the first or second connectors.

13. A laundry treating system comprising a laundry treating appliance and a first basket disposed within the laundry treating appliance for receiving a first laundry load for treatment and a first clothes mover disposed within the first basket and comprising a first connector, the laundry treating appliance customizable by a user to operate in one of three configurations comprising:

a first configuration comprising a second clothes mover removably coupled to the first clothes mover and a second basket removably coupled to the second clothes mover for receiving a second laundry load for treatment, the second clothes mover comprising a second connector configured to releasably couple with the first connector, wherein one of the first or second connectors comprises a socket configured to receive the other of the first or second connectors and a cover selectively movable between a closed position and an open position to allow access to the socket, wherein the one of the first or second connectors is received within the socket and pressing the cover into the socket into the open position to allow access to the socket in the first configuration;

a second configuration comprising the second clothes mover removably coupled to the first clothes mover and the second basket decoupled from the laundry treating appliance, the one of the first or second connectors received within the socket and pressing the cover into the socket to the open position to allow access to the socket in the second configuration; and a third configuration comprising the first clothes mover disposed in the first basket and both the second clothes mover and the second basket are decoupled from the laundry treating appliance, the one of the first or second connectors withdrawn from the socket and the cover biased into the closed position to prevent access to the socket in the third configuration;

wherein one of the first, second, or third configurations is user selectable prior to executing a cycle of operation.

14. The laundry treating system of claim 13 wherein the first clothes mover comprises a low profile impeller.

15. The laundry treating system of claim 13 wherein the second clothes mover comprises a vertically oriented agitator post.

16. The laundry treating system of claim 13 wherein the second basket is at least partially disposed within the first basket in the first configuration.

17. The laundry treating system of claim 13, further comprising a controller configured to receive an input indicative of at least one of the first, second, or third user selectable configurations and control the laundry treating appliance to execute the cycle of operation based on the input indicative of the at least one of the first, second, or third user selectable configurations.

18. The laundry treating system of claim 17, further comprising a user interface configured to provide the input indicative of at least one of the first, second, or third configurations to the controller.

19. The laundry treating system of claim 17, further comprising at least one sensor configured to provide an output indicative of at least one of the first clothes mover, the second clothes mover, or the second basket, and wherein the input indicative of at least one of the first, second, or third configurations is based on the at least one sensor output.

20. A laundry treating system comprising:

a laundry treating appliance;

a first basket disposed within the laundry treating appliance for receiving a first laundry load for treatment;

a first clothes mover disposed in the first basket and comprising a first connector and a low profile impeller without a post extending upward into the first basket;

a second clothes mover comprising a vertically oriented agitator post removably coupled to the laundry treating appliance, the second clothes mover comprising a second connector configured to releasably couple with the first connector, wherein one of the first or second connectors comprises a socket configured to receive the other of the first or second connectors and a cover selectively movable between a closed position and an open position to allow access to the socket, wherein the cover is biased into the closed position; and a second basket removably coupled to the laundry treating appliance;

wherein the laundry treating system is configured to be selectively assembled and disassembled into different configurations for implementing different operations between:

(a) a first configuration in which the second clothes mover is coupled to the laundry treating appliance and the second basket is coupled to the laundry treating appliance for receiving a second laundry load for treatment, the one of the first or second connectors received within the socket and pressing the cover into the socket to the open position to allow access to the socket;

(b) a second configuration in which the second clothes mover is coupled to the laundry treating appliance and the second basket is decoupled from the laundry treating appliance, the one of the first or second connectors received within the socket and pressing the cover into the socket to the open position to allow access to the socket; and (c) a third configuration in which both the second clothes mover and the second basket are decoupled from the laundry treating appliance, the one of the first or second connectors withdrawn from the socket and the cover biased into the closed position to prevent access to the socket.

21. The laundry treating system of claim 20 wherein the first connector comprises the socket and the cover, the cover received within the socket in at least the open position.

22. The laundry treating system of claim 20 wherein the removable coupling of the second clothes mover to the laundry treating appliance comprises the second clothes mover removably coupled to the first clothes mover.

23. The laundry treating system of claim 22 wherein the removable coupling of the second basket to the laundry treating appliance comprises the second basket removably coupled to the second clothes mover.

* * * * *